United States Patent [19]

Kite et al.

[11] 4,373,722

[45] Feb. 15, 1983

[54] ELECTRONIC VEHICLE RACE SIMULATOR

[75] Inventors: Kenneth M. Kite; Allen F. Eberts, both of Cincinnati; Joseph A. Cocovich, Loveland, all of Ohio

[73] Assignee: CPG Products Corp., Minneapolis, Minn.

[21] Appl. No.: 158,835

[22] Filed: Jun. 12, 1980

[51] Int. Cl.[3] ..... A63F 9/14

[52] U.S. Cl. ..... 273/85 G; 273/86 R

[58] Field of Search ..... 273/85 R, 85 G, 86 R, 273/86 B, 85 G, 1 GA, 1 E, 1 ES, 313; 434/69, 71, 38–43, 48–54, 61, 62, 238–244, 30; 364/718, 410; 340/584 R, 584 E

[56] References Cited

U.S. PATENT DOCUMENTS

| | | | |
|---|---|---|---|
| 3,171,215 | 3/1965 | Glass et al. | 273/1 GA |
| 3,403,908 | 10/1968 | Sheldon et al. | 273/86 B |
| 3,471,627 | 10/1969 | Ziegler | 434/243 |
| 3,718,987 | 3/1973 | Carver | 434/48 |
| 3,831,172 | 8/1974 | Olliges et al. | 273/85 R |
| 4,148,485 | 4/1979 | Rains | 273/86 R |
| 4,150,497 | 4/1979 | Weber | 434/71 |
| 4,162,792 | 7/1979 | Chang et al. | 273/85 G |

*Primary Examiner*—Vance Y. Hum

*Attorney, Agent, or Firm*—Gene O. Enockson; L. MeRoy Lillehaugen; Stuart R. Peterson

[57] ABSTRACT

A battery operated electronic drag race simulator includes a casing having hand grips at each side. When an on-off ignition switch is closed, a first light emitting diode (LED) numeric display immediately indicates the maximum engine RPM or tachometer reading that cannot be exceeded for the class of race the player has selected. A race start indicator or "Christmas tree" produces an automatic sequential energization or countdown of a yellow lights followed by the energization of the green start light signifying that a race has officially begun. Depressing a gear pushbutton and then depressing a gas pushbutton, causing a brief tire squeal sound to be produced via a speaker. The gas button causes a varying frequency signal to be generated that produces a sound resembling various engine speeds. A frequency varying signal representative of engine speed during the race is employed to constantly change the RPM reading on the numeric display. If the maximum RPM for the class of race that has been selected is exceeded, a noise signal is produced, causing the speaker to provide a sound resembling that of an engine explosion, and the race is ended immediately. When the race is over, the display that has been displaying the engine speed or RPM to the player then is caused to display a first number indicative of the overall elapsed time taken for the race and shortly thereafter a second number is caused to appear signifying the miles per hour the player has achieved.

35 Claims, 15 Drawing Figures

ELECTRONIC VEHICLE RACE SIMULATOR

BACKGROUND OF THE INVENTION

1. Field of the Invention

This invention relates generally to an electronic device for simulating a vehicle race, and pertains more particularly to a portable drag race simulator in which the player manually controls the device to produce certain audio and visual effects resembling an actual race without a vehicle or physical replica thereof being employed.

2. Description of the Prior Art

Although there is perhaps no perfect substitute for the thrills and excitement of a real drag race, the need for an outdoor track or strip, the cost of clock or timing equipment, and the expense of participating, as well as other factors, have all proved to be serious drawbacks.

To some degree, the problem of space for a track or strip has been minimized with the apparatus described in U.S. Pat. No. 3,606,328, issued to John B. Delphia et al on Sept. 29, 1971 for "VEHICLE DRAG RACE SIMULATOR ASSEMBLY". However, the cost of constructing two side-by-side bays capable of accommodating two full-size vehicles and the controls associated with the costly dynamometer-like rollers has militated against installations of this type.

Therefore, it is not surprising that an attempt has been made to provide a game for simulating an actual race. A game simulating the sights and sounds of vehicles racing on one or more adjacent tracks has been patented. In this regard, U.S. Pat. No. 4,174,833 was granted on Nov. 29, 1979 to Michael Hennig et al for "SIMULATED ROAD RACING GAME". Although only toy vehicles are required, the illusion of a real road race necessitates the provision of movable belts for the miniaturized vehicles with attendant complex and costly controls. Apparently, the relatively expensive game is intended for use at amusement parks and playgrounds where the cost per user would be reduced by the simple expedient of increasing the number of players.

SUMMARY OF THE INVENTION

The invention has for a general object the provision of an electronic game that will simulate the characteristics of a real vehicle race, more specifically a drag race, without resort to moving parts (other than certain controls that are manually actuatable or movable by the player) as in the past. In this regard, an aim of our invention is to obviate the need for either vehicles or replicas thereof, and the moving accessories heretofore required to impart the desired degree of illusion.

Another object of the invention is to provide a completely electronic drag race simulator that will produce a sufficient number of sounds and visual effects normally associated with drag racing in a way that will prove intriguing to various age groups.

Another object is to provide an electronic drag race simulator that will prove challenging to the player or user in that he must discipline himself as far as the manner in which he operates the controls. In this regard, he has the choice of selecting the particular class of drag race that he wishes to participate in and once having selected the class of drag race, then he must observe certain restricting criteria of a predetermined maximum engine speed or RPM that cannot be exceeded and exercise as much skill as he can in order to excel over other participants.

A further object of the invention is to provide a device for simulating the acceleration and speed of a vehicle engine, which are determined by the player, and producing a sound closely resembling the particular speed resulting from the player's control.

Still further, an object of our invention is to provide an electronic game that will not only possess a high degree of realism in that it will simulate sounds resembling the speed of a vehicle engine, but provision is made for automatically furnishing an explosion-like sound if the player has exceeded a predetermined engine speed. An aim of the invention is to permit the player to initially select a particular class of race which has a given maximum RPM assigned thereto. The player is then bound by the skill category he has selected.

Also, the invention has for an object the providing of a sound resembling the screeching or squealing of tires at the start of a race when the player shifts from neutral to first.

Another object is to provide a numerical display corresponding to the particular engine RPM or speed that is producing the sound.

Yet another object of the invention is to provide a race start indicator constituting so-called Christmas tree lights with the sequenced energizing thereof to provide a prestage period and successive staged intervals followed by the energizing of a start light signifying that the race has officially begun. A red foul light is intermittently energized at the end of the race and continuously energized when a player has become disqualified. For example, an aim of the invention is to disable the device if the player exceeds the preset engine RPM or jumps the start light, the foul light then automatically being turned on.

Also, the invention has for an object the visual display of the total or elapsed time measured from the start of the race and followed shortly thereafter with a display of the miles per hour that has been achieved.

Another object of the invention is to provide a lightweight and portable vehicle race simulator that can be held conveniently in one's hands and which has its controls readily accessible for manipulation by the player's thumbs during a simulated race.

It is also an object of our invention to provide a self-contained, compact device for simulating vehicle races in which still greater realism is added by virtue of the casing being configured so as to resemble a modified steering wheel.

Still another object is to provide an electronic vehicle race simulator that can be manufactured at a relatively low cost, thereby encouraging its purchase by a relatively large number of people.

A further object is to provide an electronic drag race simulator that is basically simple and easy to master as far as the controls are concerned, yet which enables the player to exhibit a considerable amount of skill. In this way, the simulator remains challenging for relatively long periods of time.

Lastly, an object of the invention is to provide for the interconnection of two identical simulators so that two players can compete against each other at the same time. In other words, not only can a single participant play against the clock, so to speak, but the invention also permits two players to play against each other with the winner automatically determined. In this regard, the invention also has as an aim to permit one player, when two are playing, to have a handicap provided him by merely positioning the race class selector switch for whatever class of race he wishes, the slower classes giving the handicapped player a head start.

Briefly, our invention contemplates an all electronic game that can be readily held in one's hands for simulating a vehicle race without the inclusion therein of any moving parts or components other than the control buttons which are manually operated by the player before and during a simulated vehicle race. More specifically, the player selects the skill or race category and when an on-off ignition switch is turned on a predetermined maximum engine speed or "red line" RPM associated with the class of race he has selected is immediately displayed in digital form. Shortly thereafter the sound corresponding to an idling engine is produced via a speaker and its digital counterpart representing the idling speed RPM is substituted for the maximum or red line speed initially presented. Concurrently, the gear position is displayed at a location spaced somewhat from the RPM display.

A gas pushbutton controls the engine speed and a gear pushbutton controls the gear position. Both the gear pushbutton and a start switch must be simultaneously depressed to initiate the prestage period and the staging period. Yellow lights are sequentially energized as a result of the depressing of the gear and start pushbutton. A green light becomes energized after the staging period and the race officially starts.

The gas pushbutton when depressed causes the pitch of the engine sound to steadily increase and also a higher numerical value denoting the higher RPM associated with the higher pitched sound which resembles a higher engine speed. The depressing of the gas pushbutton at the proper time causes a sound resembling the squeal of tires during a rapid start to be produced. At any time the predetermined maximum or red line RPM is exceeded, a noise resembling the explosion of an engine results and the race is terminated. The player quickly learns not to reach the prohibited engine speed, yet the total elapsed time for the race is dependent upon high ability to shift gears at the proper moment when the speed is just under the maximum that is permitted. In other words, an individual player is playing against the clock, so to speak: (1) If he shifts too early his elapsed time will be high and he will lose the race, or (2) If he shifts too late, he can easily exceed the red line or maximum speed, then blowing the engine, which terminates that particular race.

The progress of the race is indicated by a reverse sequencing of the staging lights. At the end of the race a red light is intermittently flashed, whereas it is on continuously for a brief period when a disqualification has occured. When the race is over the elapsed time is first displayed and then the miles per hour at the end is shown.

When two of our simulators are interconnected, all of the features of a single use are retained. In addition, however, the two compete in real time and one player can even by given a race class handicap if mutually agreed to.

DESCRIPTION OF THE PREFERRED EMBODIMENT

Figure 1:
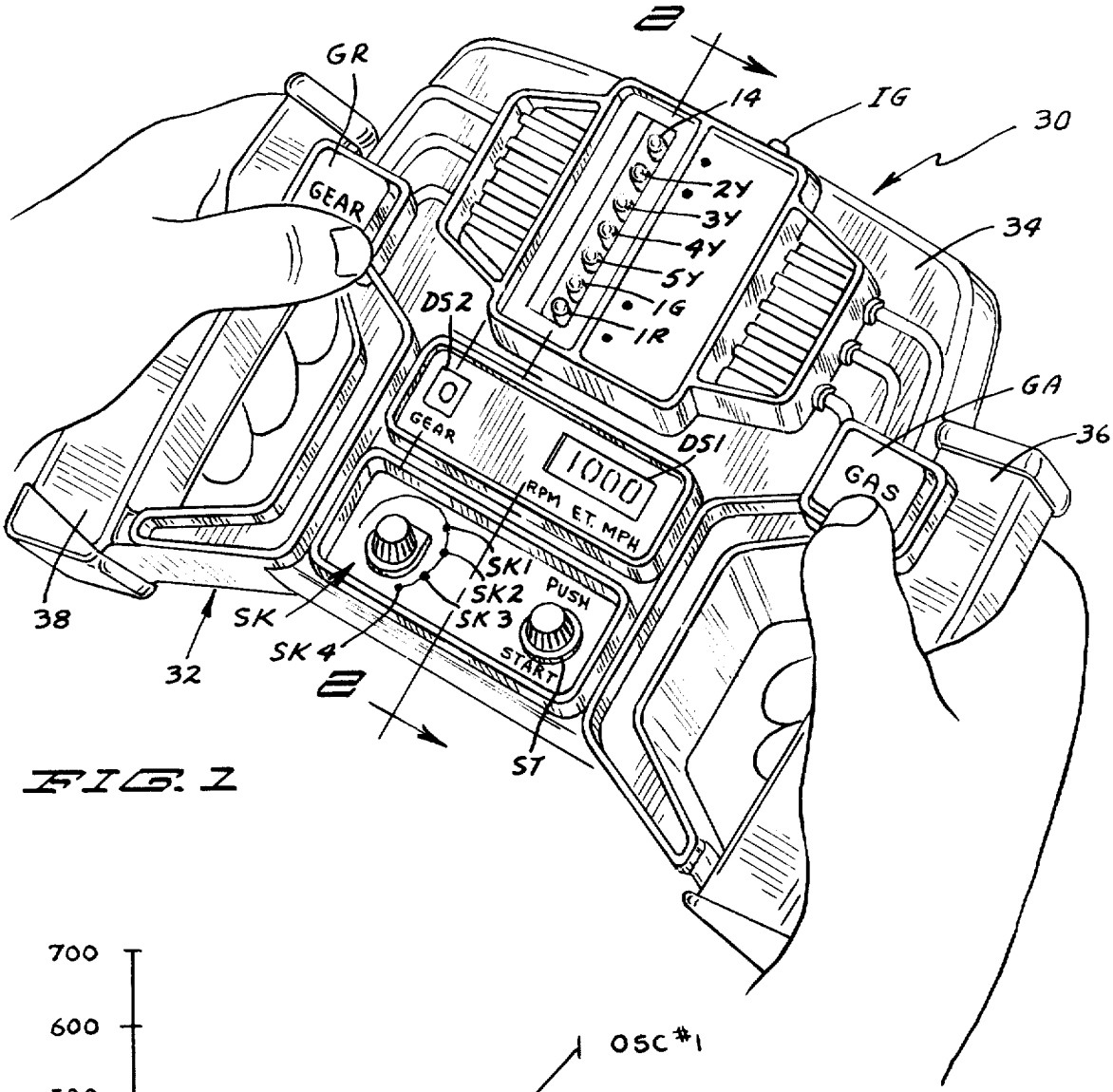
FIG. 1 is a perspective view of an electronic drag race simulator exemplifying our invention as it appears when being held in a player's hands during a race.
Figure 2:
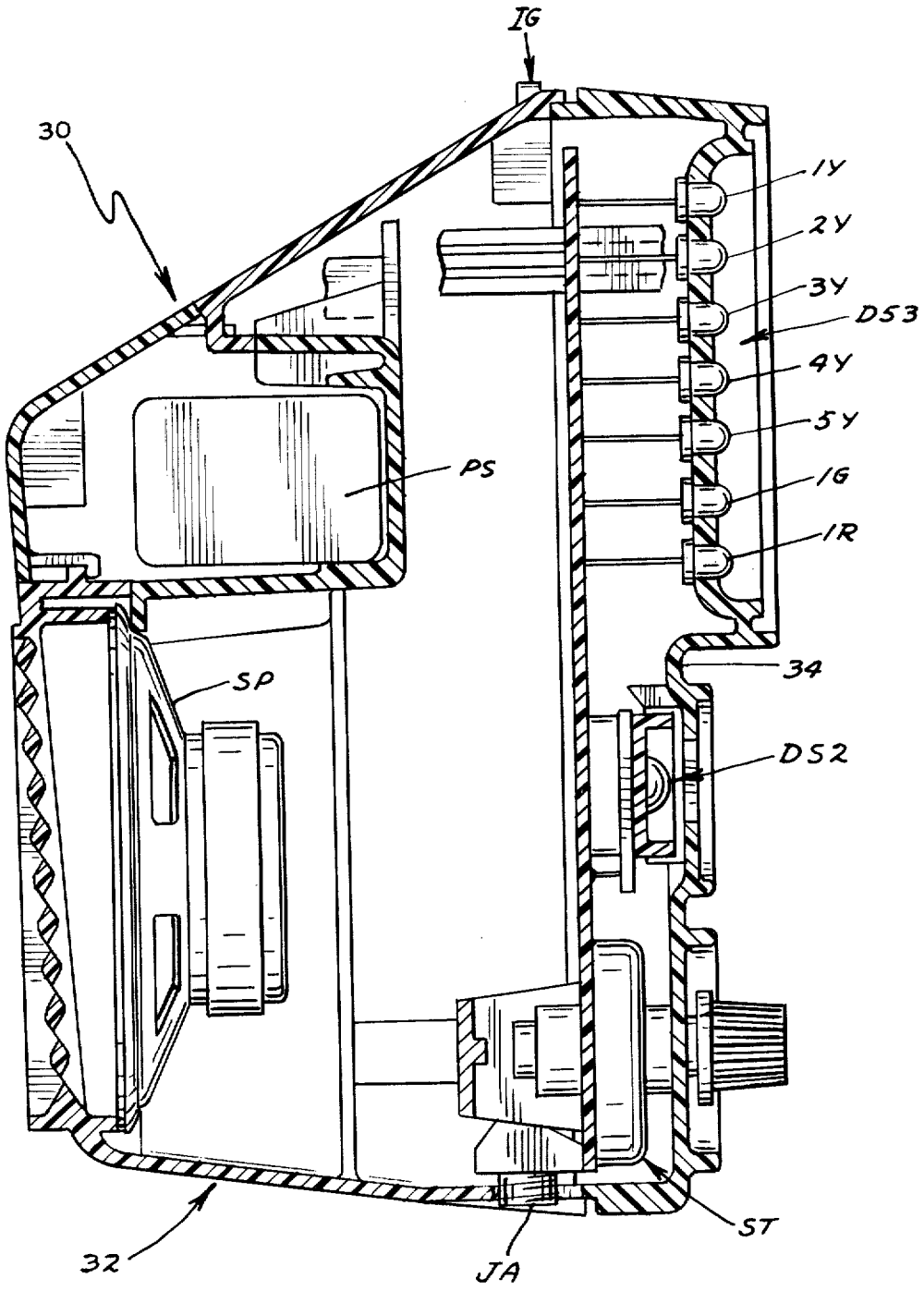
FIG. 2 is a sectional view taken in the direction of line 2—2 of FIG. 1.

Referring first to FIGS. 1 and 2, the teaching of our invention are embodied in the electronic drag race simulator which has been denoted in its entirety by the reference numeral 30. The simulator 30 includes a console or casing 32 having a front panel 34 with flanking right and left hand grips 36 and 38, respectively. Not only is the simulator 30 compact and self-contained as to all of the components of which it is comprised, but the overall configuration thereof is designed to convey the impression of a race car steering wheel.

At the top of the console or casing 32 is an on-off ignition switch IG which connects a power supply PS comprised of two 9 volt batteries PS1 and PS2 (FIG. 3B) to circuitry hereinafter described.

In actual drag racing, various classes or skills have been established. Inasmuch as an object of the instant invention is to simulate an actual drag race, it is planned that four different racing classes be capable of being selected. Therefore, a rotary skill level selector switch SK is utilized for determining any one of four racing categories. It will help to label the various positions, each denoting a particular class, that precondition the simulator 30.

With respect to the above, it can be explained that position SK1 represents a stock car class in which the vehicles compete in a form corresponding closely to that in which they were manufactured at the factory. Position SK2 signifies a modified production class, this class permitting some modifications or deviations from the form in which the car was produced at its factory. Position SK3 represents the so-called funny car class in which modifications, such as relocating the engine, are virtually unlimited. The fourth or top fuel class is the most skilled one, in practice being restricted to the fastest cars at a meet; this position has been labeled SK4 in FIG. 1. It will be appreciated that the four classes are only typical, there being many classes, and subclases within classes, that have become popular in drag racing. Nonetheless, the four that have been selected will suffice to demonstrate the versatility of our electronic drag race simulator 30.

At this time, attention is directed to a pushbutton start switch ST. This switch ST is a normally open switch, being biased to its open position but readily depressed to close its contacts. Having a somewhat different shape is a gas switch GA, also of the pushbutton variety. Here again, its switch contacts are normally open, being closed when depressed. As the description progresses, it will be learned that the gas switch GA controls the "acceleration" or "speed" of a hypothetical vehicle's engine. Another switch having the appearance of the switch GA is a so-called gear switch GR which is also of the pushbutton type, being normally open but readily closed when pushed or depressed.

A first numeric display unit DS1 is composed of a number of light emitting diodes (LED's) and it will later become clear that this display unit DS1 first shows the red line engine speed or revolutions per minute (RPM) of the engine that must not be exceeded for the particular skill class selected by means of the selector switch SK. During the warm-up period, that is prior to the official start of a simulated race, the display unit DS1 will display an RPM reading corresponding to the idling speed of the hypothetical engine if the player does not actuate the gas pushbutton switch GA; if he depresses the switch GA, then the displayed value increases accordingly. During the actual simulated race, however, the display unit DS1 always shows whatever engine RPM is produced by depressing the gas or accelerator switch GA. At the end of the race the display unit DS1 visually informs the player of the elapsed time (ET) of the race followed shortly thereafter by the displayed numeric value which automatically changes to the final speed in miles per hour (MPH) at the end of the race.

Turning now to a second LED numeric display unit DS2, this display exhibits the particular gear position that the vehicle is in. It is controlled by the gear pushbutton switch GR and indicates neutral (0), first (1), second (2), third (3) and fourth (4) gearshift positions.

It can be pointed out that this stage of the description that the display unit DS1 shows four digits, being capable of displaying the maximum value of "9999". It should be borne in mind, though, that the gas pushbutton switch GA determines the engine speed and this engine speed is digitally shown on the display unit DS1. Similarly, it should be remembered that the gear pushbutton switch GR determines the gear engagement position and this value is digitally shown on the display DS2.

Actually, these two display units DS1 and DS2 are in the form of a single module capable of displaying nine digits, although only five of the nine stations are made use of; more specifically, four of them are utilized in the providing of the RPM (plus ET and MPH) display unit DS1 and but one is used to provide the gear display unit DS2. A portion of the front panel 34 blocks from view the four digit stations that would be between the numeric display unit DS1 and the leftmost display unit DS2. It will, of course, be appreciated that the display module DS1, DS2 is conventional, being a standard display, such as used in hand-held calculators. Thus, it will be understood that each station or digit panel consists of seven segment-type displays and that these segments are arranged so that by lighting an appropriate combination of the segments any one of the numbers "0" through "9" can be formed and displayed.

Further contributing to the realism of the simulator 30 is a race start indiciator in the form of a third display unit denoted by the reference character DS3. The display unit DS3 is comprised of a straight line bank or group of LED's which will be given appropriate prefixes to denote the color thereof. In this regard, the upper five LED's are yellow and reading downwardly from the top they have been labeled 1Y, 2Y, 3Y, 4Y and 5Y. The sixth lamp or LED from the top, which is green, has been assigned the reference numeral 1G and the seventh or bottom lamp or LED, which is red, has been labeled 1R.

Figure 3A:
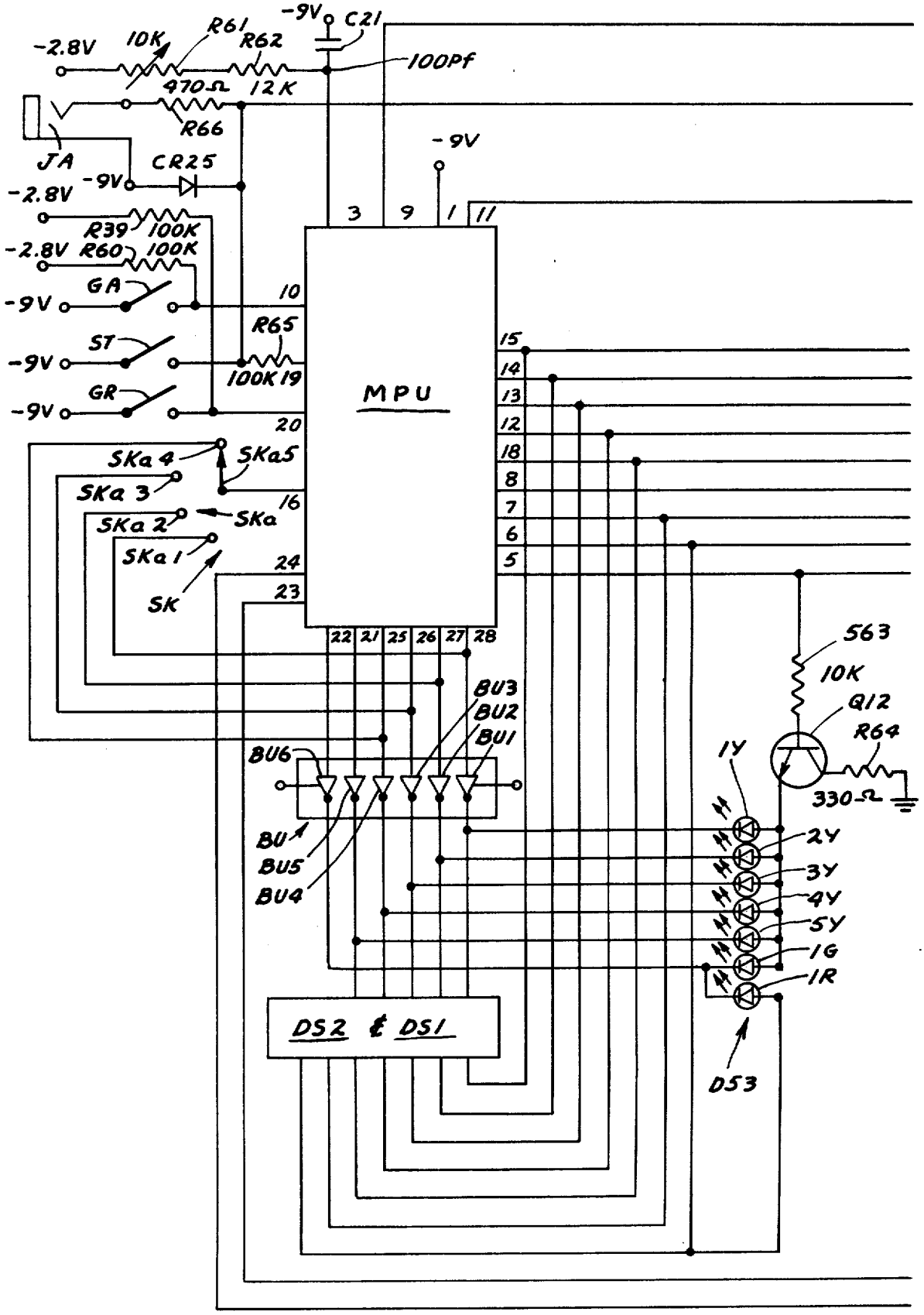
FIGS. 3A, 3B, 3C, 3D and 3E collectively constitute a schematic diagram depicting the electrical features of our invention when arranged horizontally with FIG. 3A at the left.
Figure 3B:
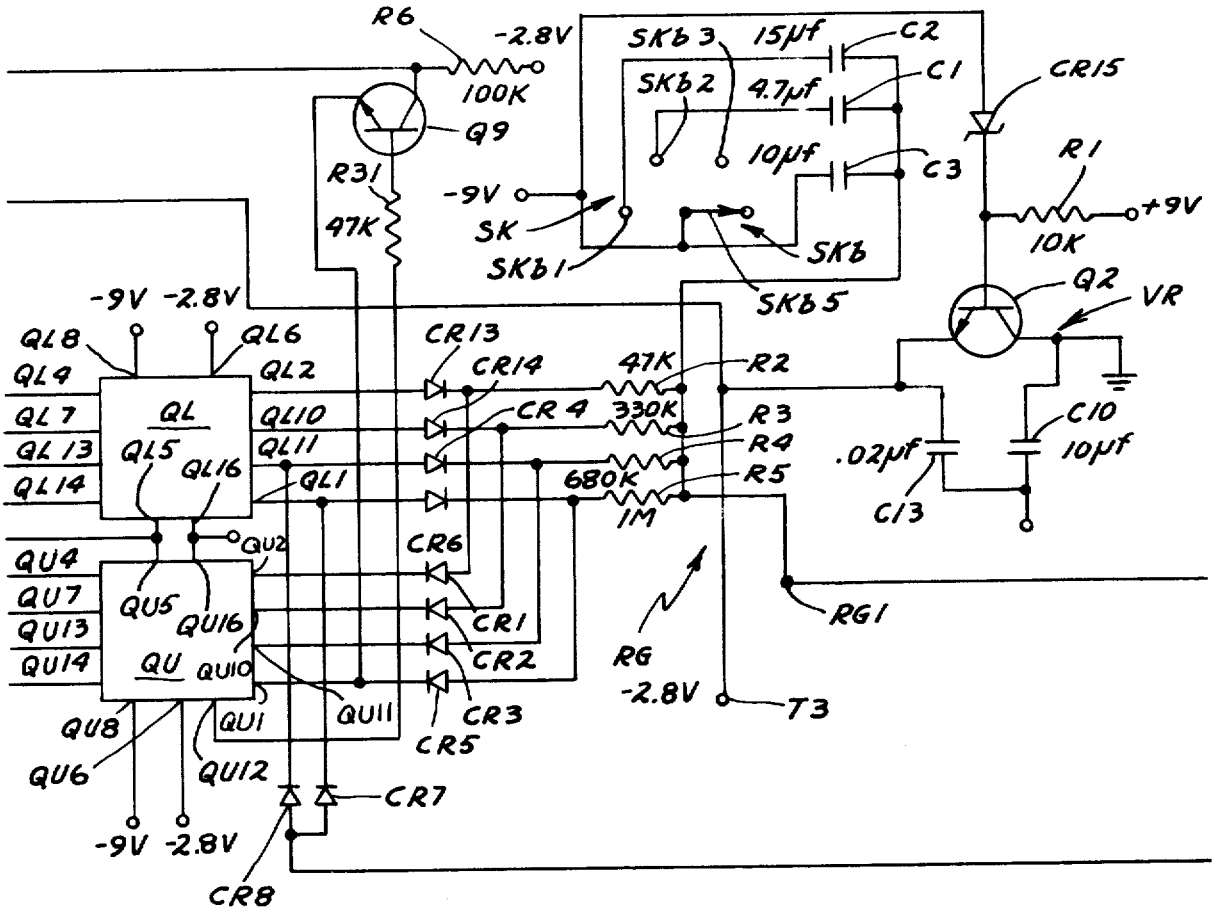
Figure 3C:
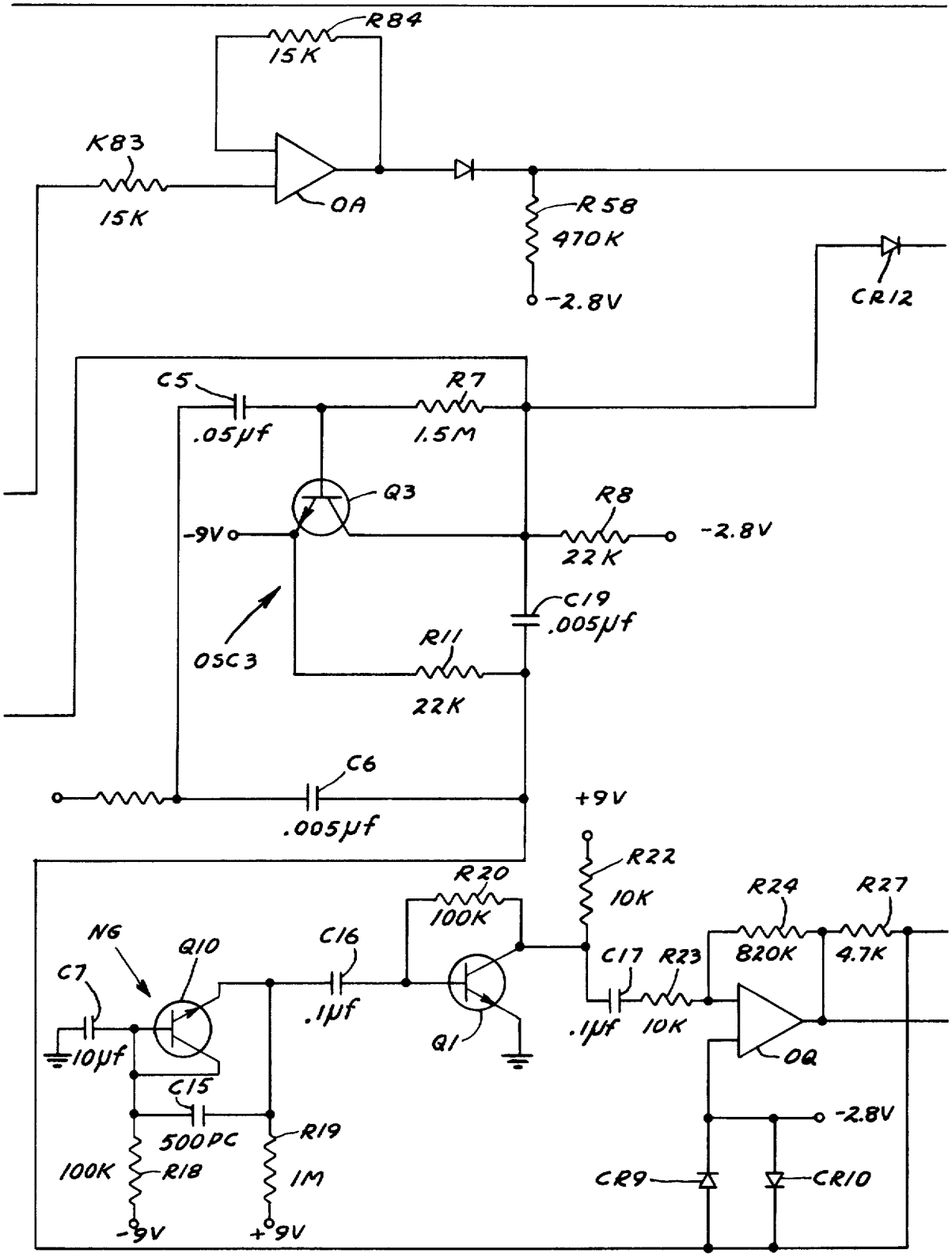
Figure 3D:
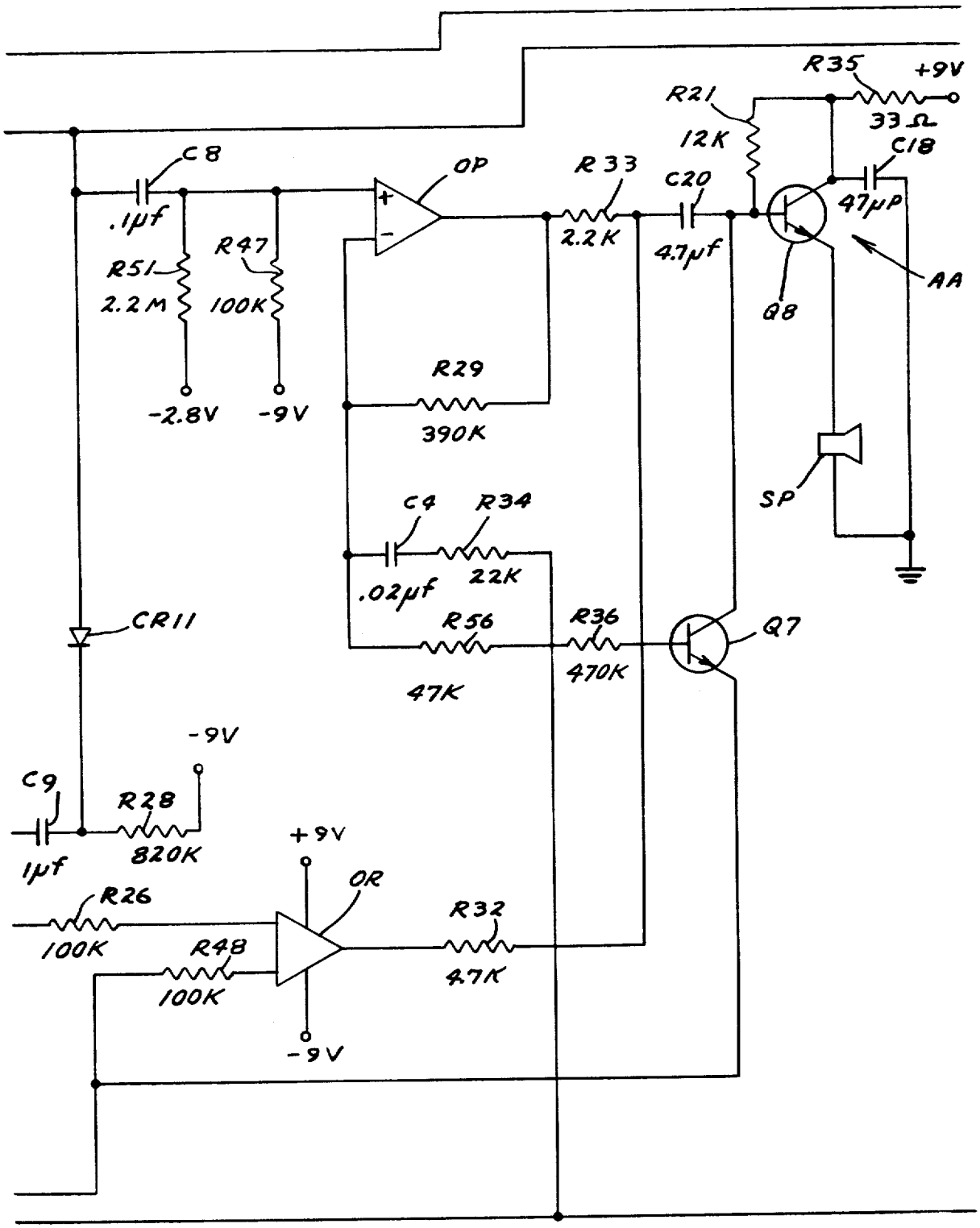
Figure 3E:
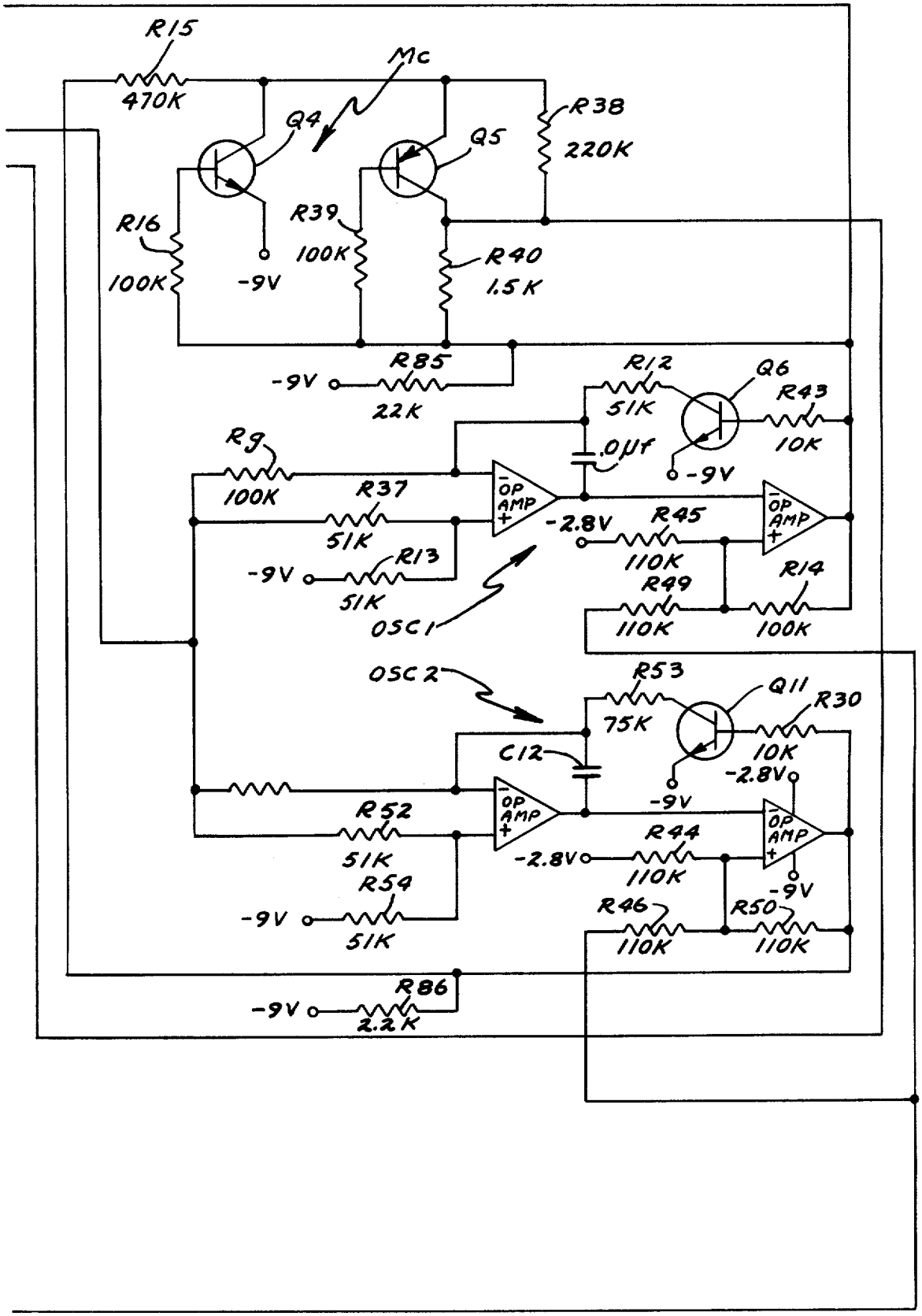
Figure 5A:
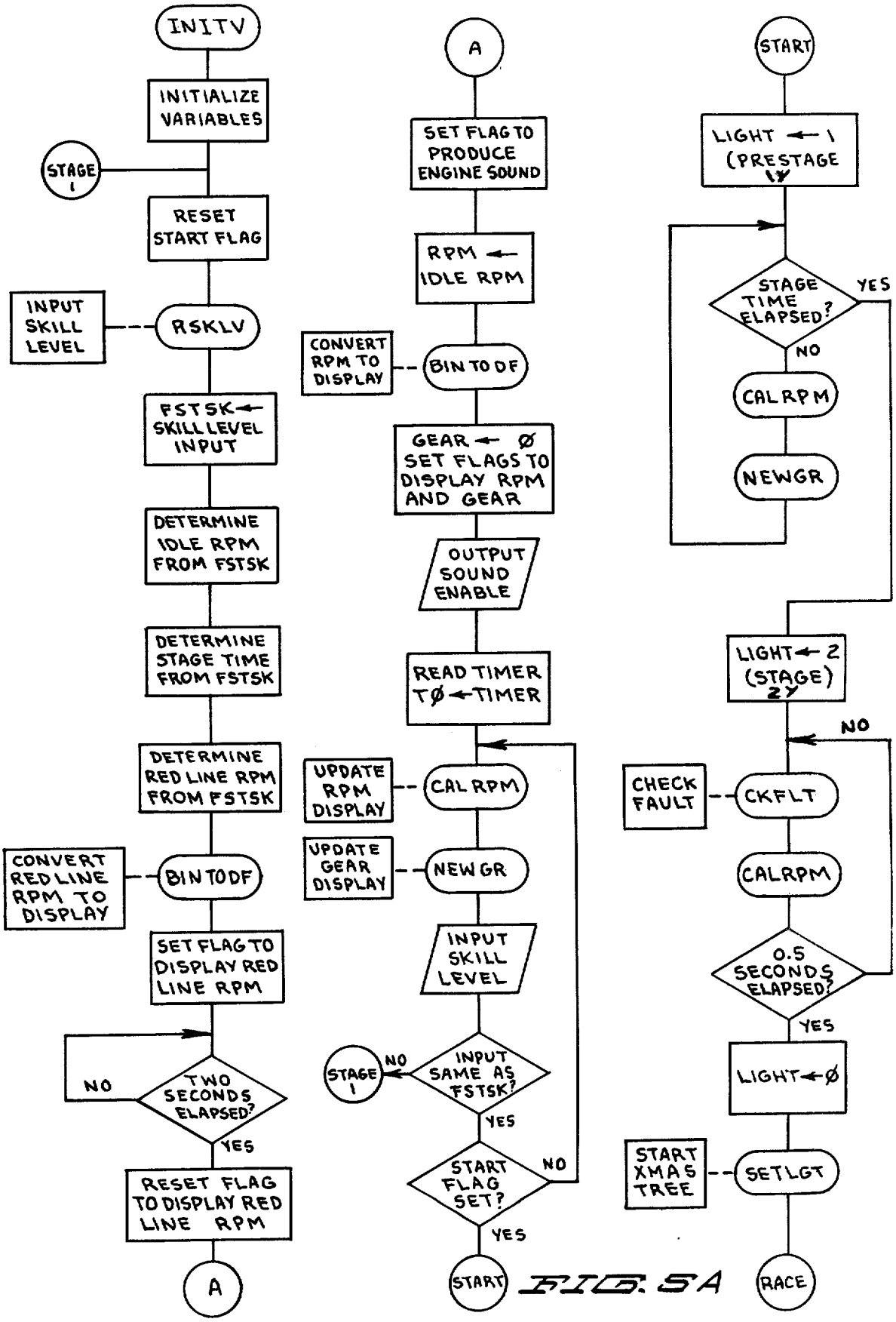
FIGS. 5A-5G are flow charts of a program which may be implemented in the microprocessor of FIG. 3A.
Figure 5B:
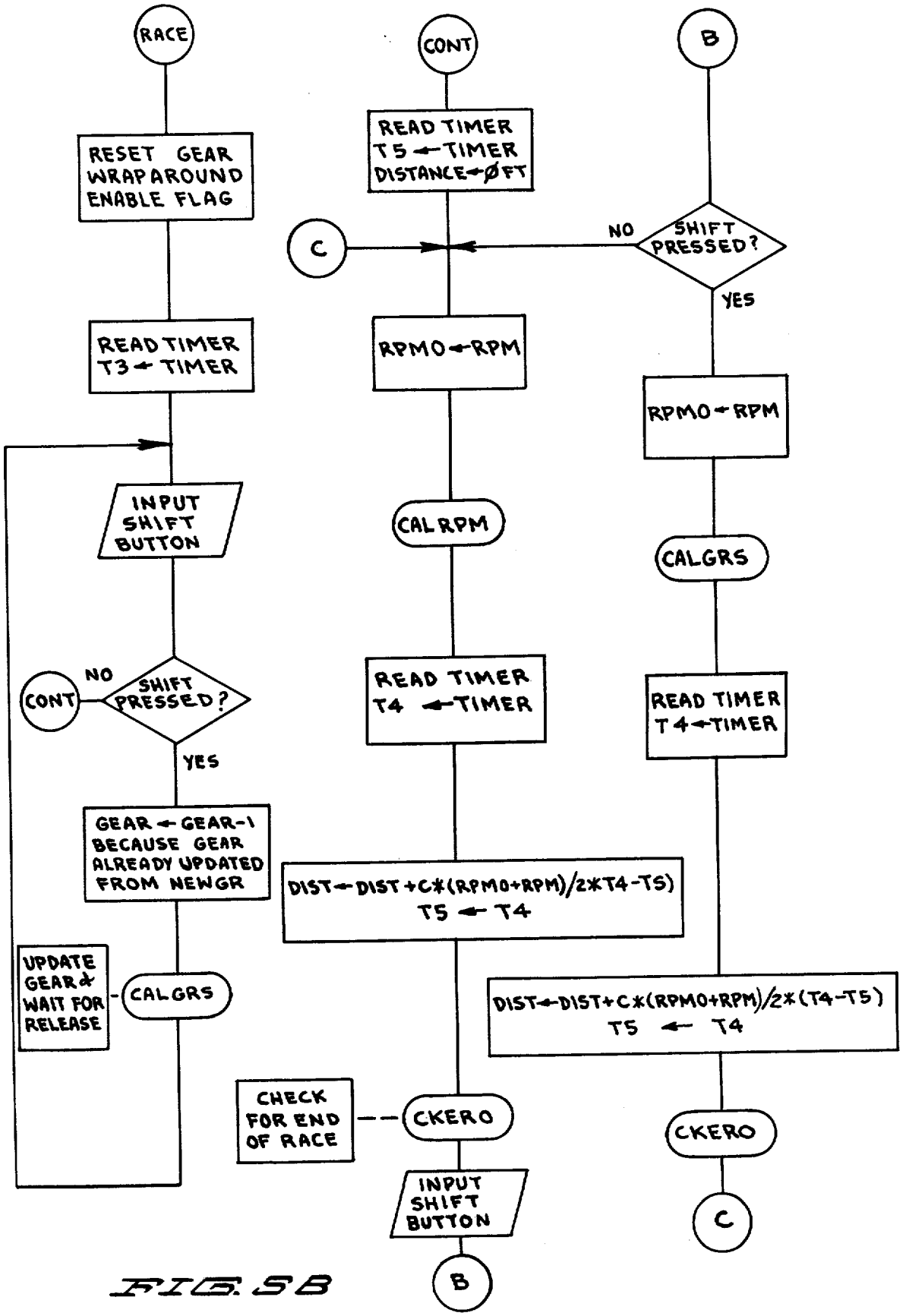
Figure 5C:
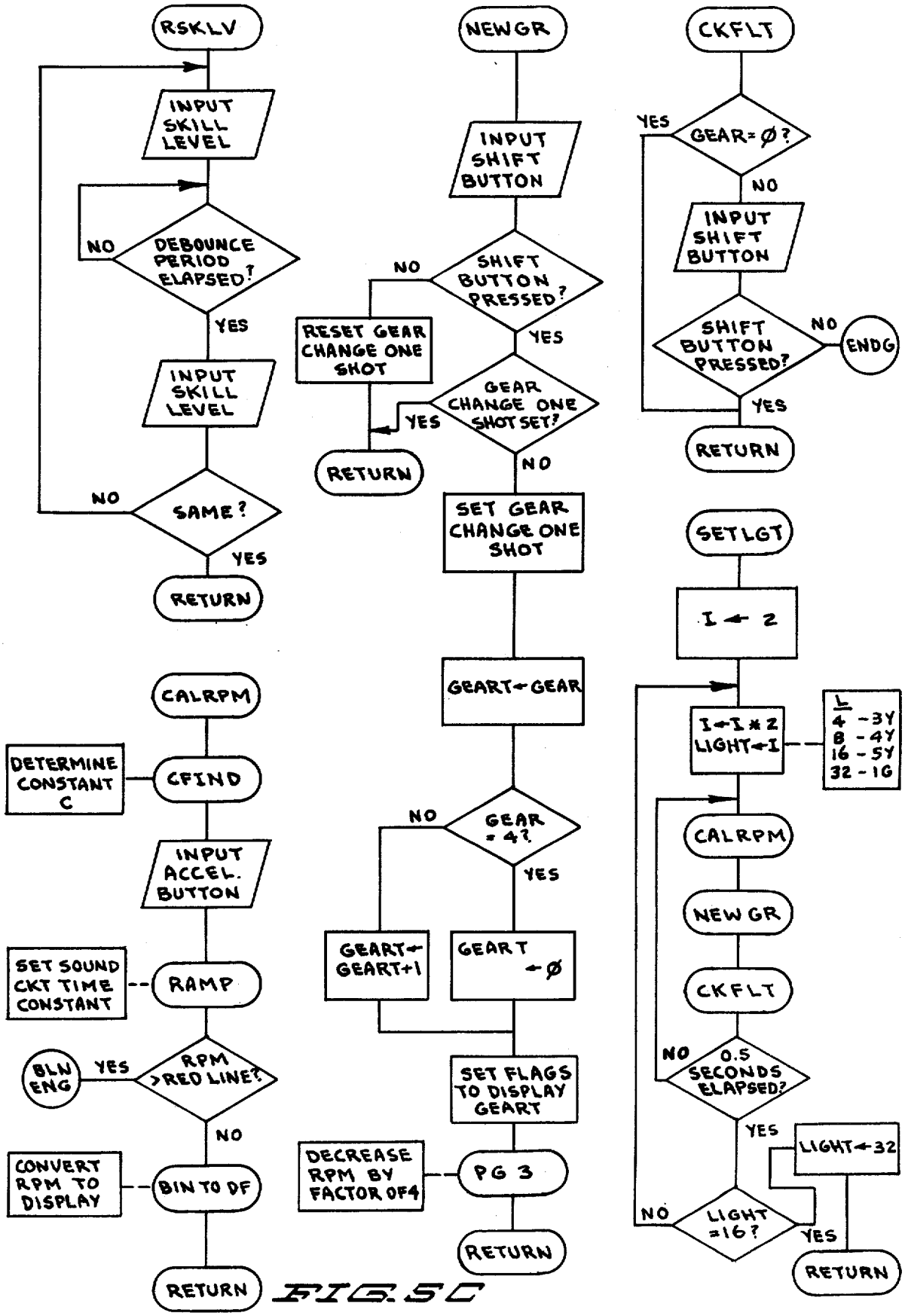
Figure 5D:
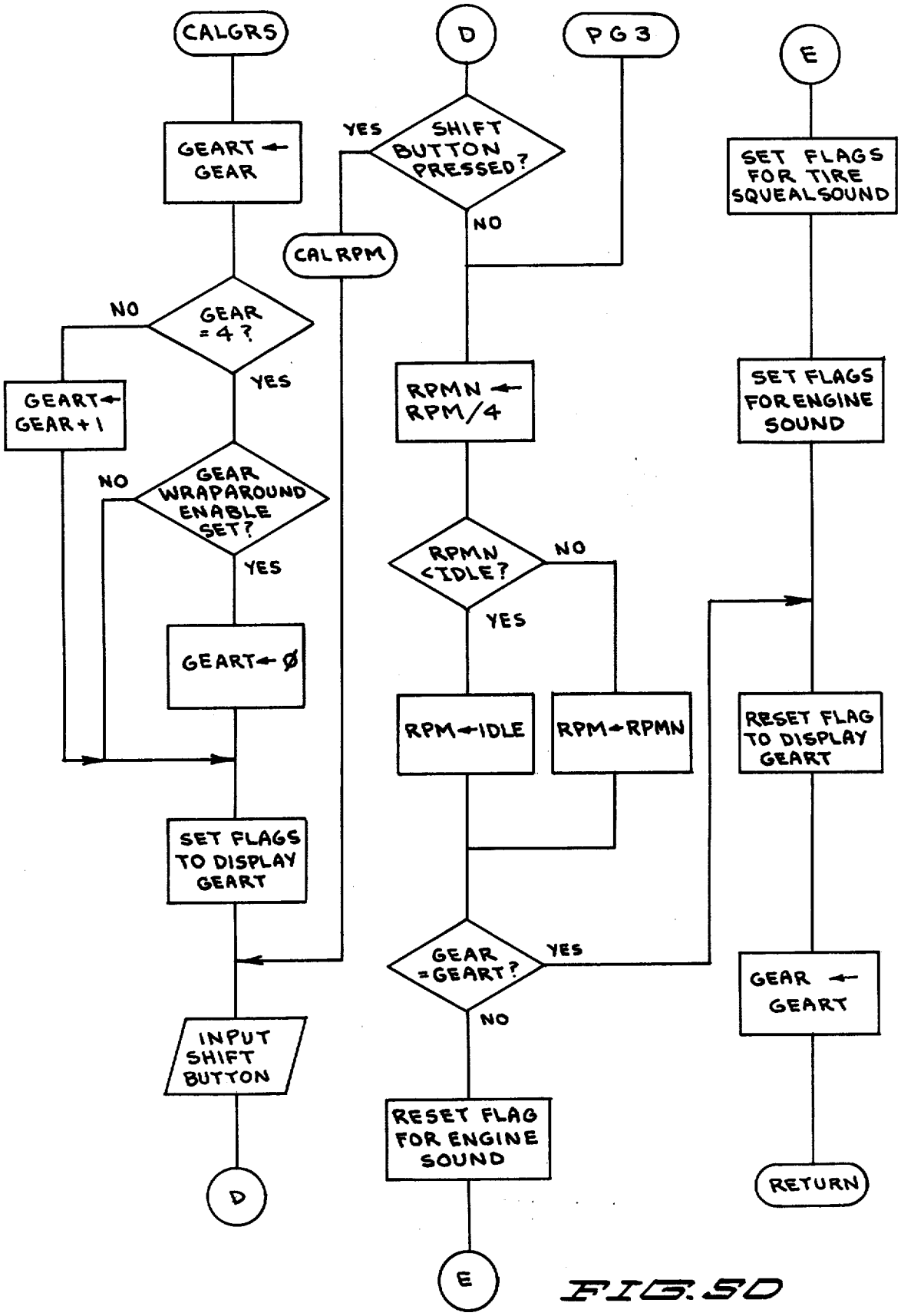
Figure 5E:
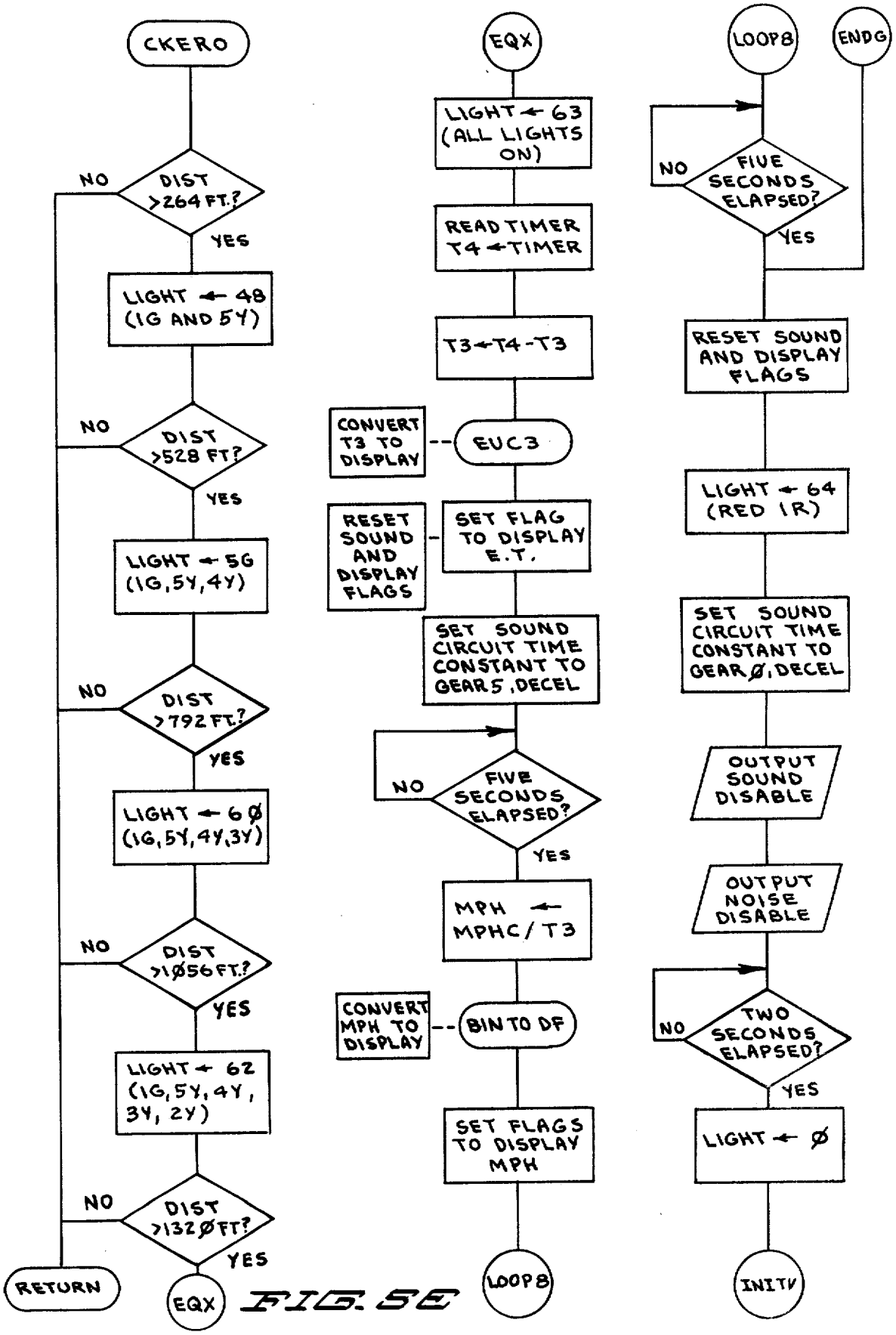
Figure 5F:
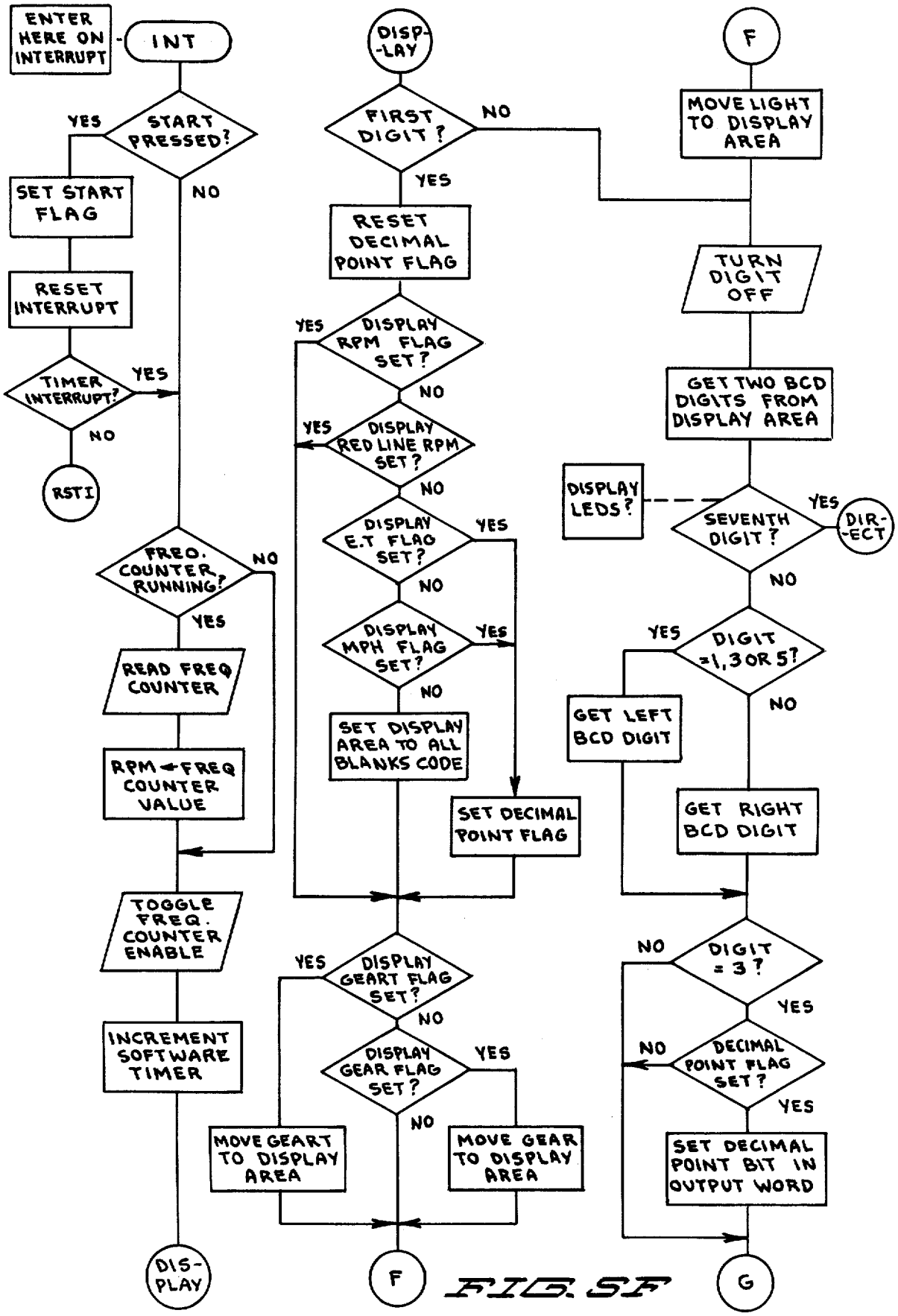
Figure 5G:
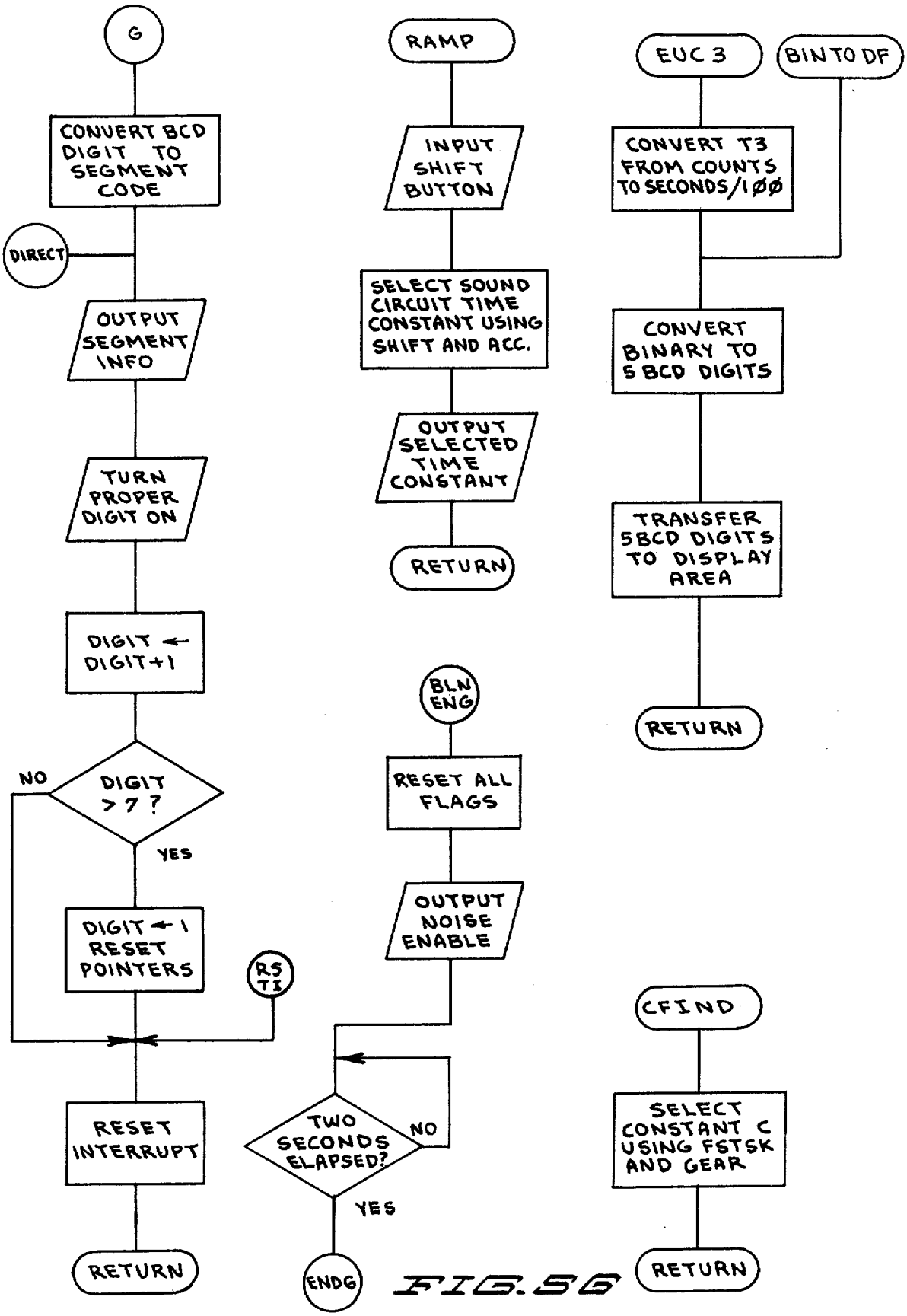

From FIG. 2 it can be perceived that a speaker SP pictorially appears at the rear of the casing 32, being shown diagrammatically in FIG. 3D. The speaker is employed for the purpose of providing several distinct sounds resembling engine speed variations before, during and after a race, a tire screech or squeal when starting a race, and an engine explosion whenever a red line or predetermined maximum RPM is exceeded. The manner in which these sounds are produced will be treated fully hereinafter.

A game interconnect jack JA appears in FIG. 2 which permits an identical simulator 30 to be plugged into the simulator 30 shown in FIGS. 1 and 2 in order that two players can race or compete against each other. This feature lends even more intrigue to the invention, for the selector switch SK associated with each simulator 30 can be differently positioned. In this way, one player may be provided with a handicap by giving that person a head start. More specifically, a lower setting or positioning of the selector switch SK provides the head start by decreasing the time intervals between the LED's 1Y and 2Y, the time interval increasing from the lowest position SK1 to the highest position SK4.

The exemplary power supply PS has only been rather generally referred to. It has been explained, though, that it comprises two 9 volt batteries PS1 and PS2. These batteries PS1, PS2 are connected so as to provide a +9 volt polarity at terminal T1 and a −9 volt polarity at terminal T2. The +9 V and −9 V furnished at the terminals T1 and T2 appear at various points throughout the schematic diagram presented in FIGS. 3A, 3B, 3C, 3D and 3E. However, a voltage of −2.8 volts is also required and is supplied via a voltage regulator VR having an output terminal T3 at which the −2.8 V potential is supplied. Here again, this voltage −2.8 is made use of at various points throughout the circuitry of FIGS. 3A-3D.

The voltage regulator VR comprises a transistor Q2, a Zener diode CR15 and a resistor R1. More specifically, the resistor R1 is connected to +9 V (terminal T1) so as to provide a positive bias to the base of the transistor Q2 and a reverse bias to the cathode of the Zener diode CR15, the anode of the diode CR15 being connected to −9 V. The Zener diode CR15 is selected so that its breakdown voltage will cause the transistor Q2 to impress the required −2.8 volts on the terminal T3.

The skill selector switch SK has already been referred to as being a rotary switch so as to provide the various positions SK1, SK2, SK3 and SK4, each being indicative of a particular drag race class or skill. The switch SK has two sets of contacts SKa and SKb. One set SKa is shown in FIG. 3A and includes four fixed contacts SKa1, SKa2, SKa3, and SKa4 plus a movable arm or contact SKa5, the movable contact SKa5 being on a shaft which is manually rotated in selecting the various positions SK1, SK2, SK3 or SK4 and which correspondingly effects engagement of the contact SKa5 with any one of the fixed contacts SKa1, SKa2, SKa3 or SKa4, respectively.

The second set of contacts SKb included in the selector switch SK appear in FIG. 3B and have been labeled SKb1, SKb2, SKb3, SKb4 and SKb5, the first four being fixed contacts, and the fifth one, SKb5, being movable.

All that need be understood at this stage of the description is that the movable contact SKa5 of the set SKa is ganged with the movable contact SKb5 so that the two are moved manually in unison. Stated somewhat differently, when the movable contact SKa5 is in engagement with the fixed contact SKa1, then the movable contact SKb5 is engaged with the fixed contact SKb1 and so on.

Referring now to a microprocessor indicated generally by the reference character MPU, it can be explained at the outset that it constitutes an integrated circuit which includes somewhat conventional components, such as a clock generator, counters, ROM, RAM, various registers, logic units, input-output circuitry, and a control unit for sequentially executing instructions. A microprocessor that has been found satisfactory in actual practice is the COP420 single chip N-channel microcontroller manufactured by National Semiconductor Corporation, 2900 Semiconductor Drive, Santa Clara, Calif. 95051. Inasmuch as a block diagram and other data pertaining to the alluded-to microprocessor has been published by the manufacturer and is therefore readily available, a detailed description thereof need not be given herein. However, it will help to number those pins of the microprocessor MPU in FIG. 3A that are actually used in practice with the same numbers appearing on the block diagram published by the manufacturer, National Semiconductor Corporation, for the model designated as COP420. A Panasonic MN1400 microprocessor has also been used with success.

With the above system of designating the pins of the National Semiconductor microprocessor MPU in mind, it will be noted that the pin 1 is connected to −9 V. Pin 3 is connected through a variable resistor R61 to −2.8 V. It might be explained at this point that the variable resistor R61 sets the internal clock provided in the microprocessor MPU which sequences the operations within the microprocessor and also times the race. The start pushbutton switch ST is connected to pin 19, the gas pushbutton switch GA to pin 10 and the gear pushbutton switch GR to pin 20.

At this stage, attention is directed to a buffer denoted generally by the letters BU which produces the required current for driving the display units DS1, DS2 and DS3. While the buffer BU need not be described in detail, it might be mentioned in passing that it is comprised of six individual amplifiers labeled BU1, BU2, BU3, BU4, BU5 and BU6. The amplifiers BU1, BU2, BU3, BU4, BU5 and BU6 have their inputs connected o the pins 28, 27, 26, 25, 21 and 22, respectively.

Not only does the buffer BU drive the display units DS1 and DS2, which as already mentioned constitute a ingle module, but it additionally drives the race start ndicator or display unit DS3 which has been nickamed in drag racing circles as a Christmas tree. As arlier herein pointed out, the display unit DS3 contains group of five yellow LED's, one green LED and one ed LED. The output of the amplifier BU1 is connected o the yellow or prestage LED light 1Y, the amplifier BU2 to the staging LED 2Y, the amplifier BU3 to the LED 3Y, the amplifier BU4 to the LED 4Y, the amplier BU5 to the LED 5Y, and the amplifier BU6 to both f the remaining two LED lights 1G (green) and 1R ed).

As is evident from FIG. 3A, pin 28, in addition to eing connected to the amplifier BU1 of the buffer BU, also connected to the fixed contact SKa1 of the selecr switch SK, pin 27 to the fixed contact SKa2, pin 26 the fixed contact SKa3 and pin 25 to the contact Ka4 of this same switch SK. In this way, control signals from drivers within the microprocessor MPU are applied to pin 16 via the movable contact SKa5 from pins 25–28. In other words, pin 16 senses whatever signals are applied to it through whatever position SK1–SK4 of the switch SK has been selected. The particular position SK1, SK2, SK3 or SK4, as already pointed out, determines the desired skill or class, depending upon which fixed contact Ska1, Ska2, SKa3 or Ska4 of the switch SK that the movable contact SKa5 is engaged with.

Turning now to pins 6, 7, 8, 12, 13, 14 and 15, it will be discerned that these pins are connected to the display units DS1 and DS2, which as previously explained is a single module. It can be mentioned that these various pins output appropriate signals for turning on the various LED's contained in the display units DS1 and DS2. In other words, it is the function of the control signals forwarded from the pins 6–8 and 12–15 to energize the appropriate elongated LED's in the display units DS1 and DS2 in conjunction with the outputs from the buffer BU so as to form the appropriate digital or numerical values at specified moments.

Returning to the race start indicator or Christmas tree display DS3 it will be recalled that this display contains a group of LED's (five yellow, one green and one red). Since these LED's 1Y–5Y, 1G and 1R are not to be energized all of the time, it follows that they must be conditioned or controlled in a certain way so as to be energized at the appropriate time. Therefore, cooperating with the buffer BU is a transistor Q12 having its base connected to pin 5 of the microprocessor MPU. Unless the transistor Q12 is turned on by a control signal from pin 5, none of the lights or lamps contained in the indicator or display unit DS3 will be lighted. Even when the transistor Q12 is rendered conductive by a signal outputed from pin 5, it is still essential that appropriate signals be outputed from the pins 28, 27, 26, 25, 22 and 21, these last mentioned signals being first delivered to the buffer BU that drives all three display units DS1, DS2, and DS3. More specifically, it should be noted that the LED's 1Y–5Y and 1G are the ones that are controlled by the transistor Q12. The remaining LED 1R is not controlled by the transistor Q12, for its function is to denote the end of a race by blinking or when a racer has disqualified himself by being on but not flashing, that is when a foul has been committed.

Not only does the race start indicator DS3 function at the beginning of a race when the prestage LED 1Y first is energized and then in succession the LED's 2Y–5Y culminating in the lighting of the start LED 1G and the concomitant official starting of the race, but as the race progresses, the LED's 2Y–5Y are energized in reverse order so as to inform the player as to the progress of the race. More specifically, the LED 5Y, when lighted, represents one-fifth of the quarter mile run, then the LED 4Y another fifth, then the LED 3Y another fifth and the LED 2Y the fourth fifth. When the race is ended, then the red light 1R becomes illuminated, being flashed on and off by a signal from pin 22 of the microprocessor MPU, doing so through the amplifier BU6 of the buffer BU.

In addition to being connected to the display units DS1 and DS2, as just described, pins 12, 13, 14 and 15 are also connected to a quad latch QL, more specifically its terminals QL14, QL13, QL7 and QL4, respectively. Similarly, the pins 5, 6, 7 and 8, in addition to being connected to the display units DS1 and DS2, are connected to the terminals QU14, QU13, QU7 and QU4 of a second quad latch QU of the microprocessor MPU. The pin 18 is connected directly to the terminals QL5 and QU5 of the two latches QL and QU so that clock signals (not to be confused with the previously mentioned clock signals which time the race) are delivered from the pin 18 to these terminals QL5 and QU5. The quad latches QL, QU may be (although other makes are suitable) of the type manufactured by National Semiconductor Corporation and identified as their CD4042BM quad clocked "D" latch, these quad latches having been utilized in actual practice; here again, the terminal designation is the same as that utilized by National Semiconductor Corporation in its published literature for the CD4042BM model. All that need be appreciated is that when the data or information in the form of control signals are applied to the input terminals QL14, QL13, QL7, QL4, and the terminals QU14, QU13, QU7, and QU4, accompanied by a clock transition via the terminals QL5 and QU5, whatever information or data is present on the alluded-to input terminals during the clock transition is retained at the output terminals QL1, QL11, QL10, QL2 and QU1, QU11, QU10, QU2 until an opposite clock transition occurs. In other words, the information present at the input side of the two latches QL and QU during the clock transition is retained at the output side until an opposite clock transition occurs.

The function of the quad latch QL is to control a ramp generator indicated generally as RG comprising a network of four resistors R5, R4, R3, R2 and capacitors C3, C2 and C1. When the gear pushbutton switch GR is depressed, such action causes the microprocessor MPU to output a digital word via the latch QL which determines which resistor or resistors R2–R5 are to be included in the operation of the ramp generator RG and which capacitor or capacitors C1–C3 are to be included is determined by the position SK1, SK2, SK3 or SK4 of the selector switch SK, more specifically by the engagement of the movable contact SKb5 with the fixed contact SKb1, SKb2, SKb3 or SKb4, as the case may be.

Whereas the depressing of the gear pushbutton switch GR causes the resistors R2–R5 to be selected in accordance with the digital word outputed from the microprocessor MPU, depressing the gas pushbutton switch GA causes whichever capacitors C1, C2 and C3 that have been included to be charged, release of the gas pushbutton switch GA resulting in a discharging of the capacitors through those resistors R2–R5 that have been included in the network at any given time.

As a specific example, taking into account the capacitances of the several capacitors C1, C2, and C3, when the movable contact SKb5 is engaged with the fixed contact SKb1, as it is when the selector switch SK is rotated to the position labeled SK1 (FIG. 1), then capacitor C2 is placed in parallel with the capacitor C3, producing a total capacitance of 25 uf since the capacitor C2 has been a capacitance of 15 uf and the capacitor C3 a value of 10 uf. When in the position denoted by the position SKb2, then the capacitor C1 is placed in parallel with the capacitor C3, resulting in a total capacitance of 14.7 uf inasmuch as the capacitor C1 has a capacitance of 4.7 uf. In the remaining two positions SK3 and SK4 of the selector switch SK, the movable contact SKb5 is engaged with either the fixed contact SKb3 or SKb4, causing only the capacitor C3 to be included in the R-C circuit and hence only a capacitance of 10 uf. What should be made clear is that the four resistors R1–R5 and the three capacitors C1–C3 are connected in various predetermined combinations to allow the ramp generator RG to exhibit 12 different time constants or charging rates. It may be beneficial to list these rates in table form below:

| GEAR (GR) | SKILL (SK) | CEQ | R CHARGE | R × C SECONDS |
|---|---|---|---|---|
| 1 | 1 | 25uf | 47K | 1.17 |
| 2 | 1 | 25uf | 330K | 8.25 |
| 3 | 1 | 25uf | 680K | 17.00 |
| 4 | 1 | 25uf | 1M | 25.00 |
| 1 | 2 | 14.7uf | 47K | 0.69 |
| 2 | 2 | 14.7uf | 330K | 4.85 |
| 3 | 2 | 14.7uf | 680K | 9.99 |
| 4 | 2 | 14.7uf | 1M | 14.7 |
| 1 | 3 & 4 | 10uf | 47K | 0.47 |
| 2 | 3 & 4 | 10uf | 330K | 3.3 |
| 3 | 3 & 4 | 10uf | 680K | 6.8 |
| 4 | 3 & 4 | 10uf | 1M | 10.0 |

To maintain system accuracy and some linearity, the actual portion of the capacitor charge curve used in practice varies from 0.8 time constants for position SK1 of the skill selector switch SK, 1.3 for position SK2, 1.6 for position SK3, and 1.2 for position SK4.

From the above, it should be evident that the ramp generator RG outputs a voltage in accordance with the various resistors R2–R5 that are connected in circuit with the several capacitors C1–C3. It will be helpful, it is believed, to show an output terminal which reflects the various voltage changes; this output terminal for the ramp generator RG has been identified as RG1.

The terminal assigned the reference character RG1 is connected directly to an operational amplifier OA which functions as an impedance buffer between the ramp generator RG and two oscillators described below. Basically, the operational amplifier, which can be of the LM324N type marketed by National Semiconductor Corp., prevents the ramp generator RG from being loaded down by the two oscillators now to be referred to. One oscillator has been denoted generally by the reference numeral OSC1 and the second or other oscillator by the reference numeral OSC2. These oscillators OSC1, OSC2, it can be explained, are voltage controlled oscillators, and more specifically are of the Schmitt trigger type. Inasmuch as this type of oscillator is conventional, it is not deemed necessary to describe either in any detail, especially since the components and values thereof are set forth in FIG. 3E. Each oscillator includes two operational amplifiers simply labeled "OP AMP"; they can be of the same type as the operational amplifier OA, namely model LM324N.

Figure 4:
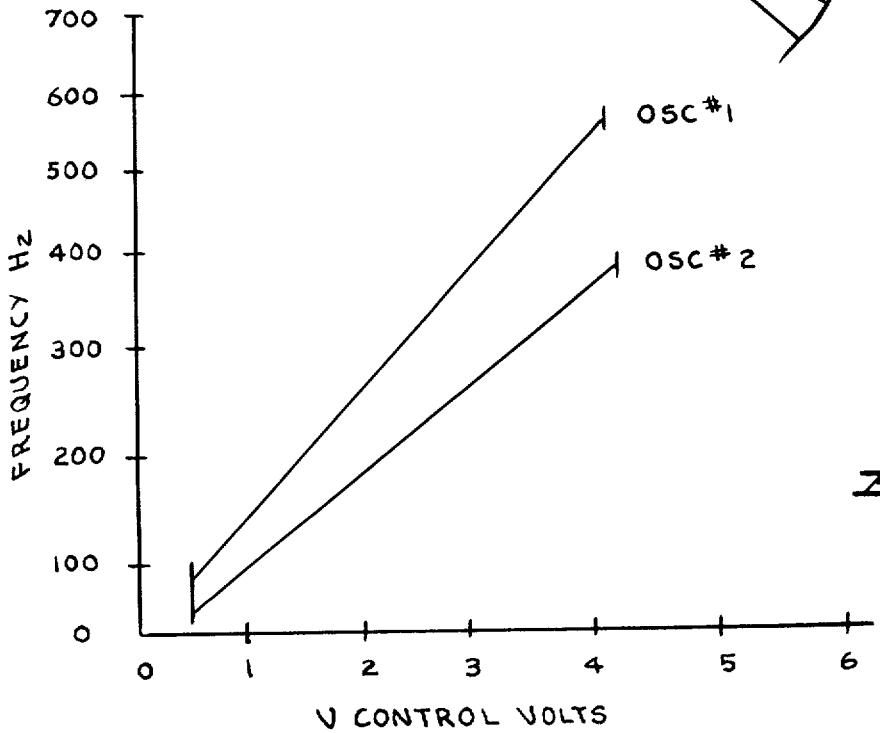
FIG. 4 graphically portrays the various frequencies derivable for different voltages provided in the control of two oscillators employed in the circuitry exemplifying our invention.

However, it will be beneficial, though, to refer to FIG. 4 where the control voltage, which appears at the output terminal RG1 of the ramp generator RG, is plotted horizontally and the resulting or output frequency for each is plotted vertically. Typical straight line control voltages for the oscillators OSC1 and OSC2 have been shown. From FIG. 4 it can be noted that the two oscillators OSC1 and OSC2 have virtually linear transfer characteristics.

Since the voltage controlled oscillators OSC1 and OSC2 are of the Schmitt trigger variety, they output a near-symmetrical square wave and both have linear transfer characteristics as just mentioned and which relationships are shown in FIG. 4. It should be pointed out, however, that the frequency of the oscillator OSC2 should be approximately 0.6 of the frequency of the oscillator OSC1 over the entire control voltage range, more specifically for an input voltage from 0–6.2 volts. Although the various components constituting the ocillators OSC1 and OSC2 have not been referred to and described, it might be well to briefly mention the presence of trimming resistor R12 in the oscillator OSC1 which enables the frequency of this oscillator to be adjusted. By the same token, the resistor R53 of the oscillator OSC2 can be trimmed to adjust the frequency of this second oscillator. Consequently, the requisite ratio of frequencies can be initially obtained and thereafter maintained, even though at some expense with respect to the square wave symmetry of the two square wave output signals. The output signal from the oscillator OSC1 is fed to pin 9 of the microprocessor MPU. The microprocessor reads the frequency at its pin 9 and converts it to a RPM signal which is processed and exhibited on the display unit DS1, being representative of the varying RPM.

It will be understood that both the output signals from the two oscillators OSC1 and OSC2 have variable frequencies produced in accordance with the voltage provided by the ramp generator RG. It should be borne in mind that while the idling speed or RPM is predetermined by the lowest voltage from the ramp generator RG, the voltage is varied by depressing the gas pushbutton switch GA. While only the output from the oscillator OSC1 is utilized in providing an RPM signal, it should be noted that the outputs from the oscillators OSC1, OSC2 are forwarded to a mixing circuit MC comprised of complementary transistors Q4 and Q5, the outputs being fed in different proportions so as to produce a complex waveform of approximately 0.5 volt peak to peak. More specifically, the output from the oscillator OSC1 is impressed on the bases of the transistors Q4, Q5, whereas the output from the oscillator OSC2 is connected to the collector of the transistor Q4 and to the emitter of the transistor Q5. The resulting or mixed output signal from the mixing circuit MC, that is, at the collector of transistor Q5, is coupled via a capacitor C8 to one input terminal of an operational amplifier OP, and the output from the operational amplifier is delivered to an audio amplifier AA, more specifically, to the base of the transistor Q8 comprising the amplifier AA. A noise generator NG is also included in the circuitry, but its role is better reserved for a later discussion.

The previously-mentioned speaker SP is in the collector-emitter circuit of the transistor Q8. Hence, as the frequency of the mixed output signal from the circuit MC increases, the pitch of the sound produced by the speaker SP increases. The blending or mixing of the outputs from the two oscillators OSC1, OSC2, plus a signal from the noise generator NG hereinafter referred to, is such as to create a very realistic engine speed sound from the speaker SP, the pitch of which increases in accordance with increases in the RPM signal to pin 9. In other words, the RPM value on the display unit DS1, that is, the digital readout representative of an engine speed is correlated with the pitch of the engine speed sound produced by the speaker SP. Thus, the player is constantly apprised, both visually and audibly, as to the increase of the simulated engine speed. Both the sight sensation and the hearing sensation contribute tremendously to the realistic effect that is produced with our drag race simulator 30. It should perhaps be again mentioned at this point that there is a minimum frequency output from the oscillator OSC1, OSC2 that is mixed by way of the mixer MC to produce a sound of lower pitch simulating an idling speed. Hence, when the gas pushbutton switch GA is depressed, the frequency, and hence the speed of the engine, increases from the idling speed to various higher speeds determined by the length of time the switch GA is closed. The idling speed is initially adjusted to approximate a figure of 1,000 RPM, and as the description progresses it will be seen that the absolute maximum engine speed is 9,999 RPM. Specifically, this highest speed is associated with the position SK3 of the selector switch SK; in other words, it is possible to achieve an engine RPM of 9,999 when the funny car class is selected. The maximum speed not to be exceeded is less for the other positions, being 6,999 for position SK1, and 8,999 for positions SK2 and SK4.

Obviously, the engine speed sounds should not be heard constantly. In other words, there are certain times before a race and after a race that no sound should be produced by the speaker SP. It is the function of the transistor Q7 to switch the sounds on and off. Its base is connected to pin 24 of the microprocessor MPU. The pin 24, it can be explained, is simply connected to a register and buffer within the processor MPU which is programmed to provide a control signal which turns the sound on and off by reverse biasing the transistor Q8 of the audio amplifier AA via the transistor Q7.

Imparting even more realism to the operation of our simulator 30 is a tire screech oscillator OSC3 which includes a transistor Q3 having its base connected to the output terminals QL1 and QL11 of the quad latch QL. It will be recalled that terminals QL1 and QL11 are connected to the resistors R5 and R4, respectively of the ramp generator RG. Hence, during the very early portion of the charging of the capacitor C3 the tire screech oscillator OSC3 is triggered into operation. Its output is fed through the previously referred to operational amplifier OP by way of the capacitor C8. In this regard the screech producing signal has a tone on the order of 700 Hz which is further amplified by a factor of 14 in the mid-band frequency range. The oscillator OSC3 is enabled and is modulated by the approximately 1.2 V peak to peak noise voltage at the diodes CR9 and CR10. All that really need be appreciated is that there is a voltage of shoft duration that biases the transistor Q3 of the tire screech oscillator OSC3 into a conductive state so that for a very short interval a tire screech sound is superimposed on the sound coming from the speaker SP as produced by the ocillators OSC1 and OSC2.

There are a number of predetermined RPM or red line values that should not be exceeded. The selector switch SK determines what the maximum engine RPM should be and, as already pointed out, this varies in accordance with the skill and class that is selected. Contributing considerably more intrigue to the overall operation of our simulator 30 is the presence of the previously alluded to noise generator NG which produces or generates a pseudo white noise signal composed of a multiplicity of frequencies, the reverse biasing of the base-emitter junction of transistor Q10 producing such a noise. The breakdown voltage is approximately 8.2 V and the noise signal that is generated is approximately 1 millivolt into 10K ohms. The pseudo white noise signal originating from the reverse biasing of the emitter-base junction of transistor Q10 is amplified through the agency of a transistor Q1 by a factor of 10 and then the amplified signal from the transistor Q1 is delivered to an operational amplifier OQ, being further amplified there by a factor of 82. In the explosion mode, the white noise signal is additionally amplified by the open loop gain of the operational amplifier OR. This greatly amplified noise signal is then fed to the previously-mentioned audio amplifier AA via the transistor Q8.

Obviously, the greatly amplified explosion signal from the operational amplifier OR should not be continuously applied to the base of the transistor Q8 of the audio amplifier AA. In other words, it should only be triggered into the sound system when the maximum or red line speed has been exceeded. Accordingly, the other input terminal of the operational amplifier OR is connected to the hitherto unreferred to pin 23 of the microprocessor MPU. Hence, it is only when the microprocessor MPU provides a control signal, as derived from the RPM signal applied to its pin 9, that the explosion sound is produced by the speaker SP.

Normally, it should be mentioned, the signal originating from the noise generator NG, after amplification by the transistor Q1 and the operational amplifier OQ (but not amplified by the operational amplifier OR) is gated onto the operational amplifier OP through diode CR11 in that the output terminal of the operational amplifier OQ is connected to the junction of resistors R24 and R27, the other end of resistor R27 being coupled to the diode CR11 via capacitor C9. It is the gating of the lower level noise signal by the mixed signal from the oscillators OSC1 and OSC2 via the mixer MC that produces extremely realistic engine sounds. However, when a triggering signal is impressed on the operational amplifier OR, as mentioned above, the high gain provided by this amplifier OR produces the explosion-like sound.

It will be observed that a transistor Q9 has its collector connected to the jack JA, its emitter to the terminal QU1 of the latch QU and its base to the terminal QU12 of this latch. The transistor Q9 is used only when two simulators 30 are connected together in order to indicate the winner when two players are racing at the same time.

OPERATION

Having presented the foregoing description, the manner in which our electronic vehicle race simulator 30 operates will now be described. The first thing that the player does is to select the particular drag racing class in which he desires to participate. This is done by rotating the selector switch SK to the position SK1 if a stock car race is to be selected, to the position SK2 if a modified car race is to be undertaken, to the position SK3 if a funny car race is to be run, or to the position SK4 if a top fuel category is selected.

After having selected the class or skill of race, then the player turns on the ignition switch IG, the result of which causes the power supply PS to apply the previously appropriate voltages to the terminals PS1, PS2 and PS3. Almost immediately thereafter the LED numeric display unit DS1 shows the particular maximum or red line RPM allowed for the class that the player has selected by means of the selector switch SK. Whatever number is displayed will indicate to the player that this particular value of RPM must not be exceeded. Thus, the player is forewarned of the maximum engine speed that he nust not exceed, either prior to the starting of the race during warm-up or during the race itself.

The maximum RPM that should not be exceeded is displayed for a brief interval on the display unit DS1.

The ramp generator RG is now providing only a relatively low voltage which causes the voltage controlled oscillator OSC1 to furnish a low frequency signal indicative of idling speed to the pin 19 of the microprocessor MPU and the idling RPM is immediately shown on the display unit DS1. This is about 1,000 RPM. The output of the oscillator OSC1 is combined with that of the oscillator OSC2 to produce a relatively low frequency signal via the mixing circuit MC. The signal from the mixing circuit MC gates the noise signal from the noise generator NG, more specifically, the signal from the amplifier OQ, onto the amplifier OP, doing so via the diode CR11, and this composite signal is amplified in the audio amplifier AA, causing the speaker SP to provide a sound resembling the idling speed of an engine and which corresponds to the idling RPM on the display unit DS1, which as stated above is about 1,000 RPM.

It is at this stage that the player can pick up the simulator 30, if he has not already done so, by grasping the two hand grips 36 and 38 so that the controls can be operated manually without difficulty. During what corresponds to an engine warm-up, the player can test the gas pushbutton switch GA and also the gear pushbutton switch GR to see the changes in the readouts displayed on the display units DS1 and DS2. More specifically, the depressing of the gas pushbutton switch GA will cause the digital display of RPM to increase in accordance with the time that the switch GA is depressed. Even during this engine warm-up period, the maximum or red line RPM for the class he has selected by means of the switch SK must not be exceeded. If it is exceeded, then the engine will blow by reason of a control signal being forwarded from the microprocessor MPU, more specifically, from pin 23. It should be borne in mind that the microprocessor MPU is responsive to the frequency of the output signal produced by the oscillator OSC1 in that this signal is impressed on the microprocessor pin 19. During this warm-up period, the user can also press and release the gear pushbutton switch GR which causes the display DS2 to indicate the various positions from neutral (zero) through fourth gear, a further depressing of the pushbutton switch GR causing a wraparound on the display DS2 to again show neutral (zero).

When the player is ready to start or begin the race, he simultaneously depresses both the start pushbutton switch ST and the gear pushbutton switch GR. Although not essential to do so, the user should then release both pushbutton switches ST and GR. The simulator 30 is at this time automatically conditioned or programmed to energize the race start indicator of Christmas tree display unit DS3. The first thing that occurs is that the prestage yellow lamp or LED 1Y becomes lit, followed in succession by the other four yellow LED's 2Y, 3Y, 4Y and 5Y. During the period in which the LED's 2Y-5Y are on, the player has the option of depressing the gear pushbutton switch GR if he wishes. However, he cannot release it, which would be like taking one's foot off the clutch pedal, when the display unit DS2 is registering anything other than 0 (neutral). If he does, he disqualifies himself. What transpires, upon a disqualification or foul, is that the red lamp 1R is energized and glows constantly to visually inform the player of his disqualification. The simulator 30 is programmed to automatically reset itself in a few seconds after the red light 1R has signified a disqualification.

When the green LED 1G lights, the user presses (or he may have previously depressed it while any one of the yellow lights 2Y-5Y are on, as long as he has not released it when in any gear other than 0, that is, neutral) and releases the gear pushbutton switch GR to shift from neutral to first gear, the display DS2 showing a "1" in contradistinction to the "0" for neutral. The depressing of the gas pushbutton switch GA will result in the tire screech oscillator OSC3 forwarding a signal to the speaker SP for a brief interval of time which results in a sound simulating the actual screeching of tires during the rapid initial acceleration of a racing vehicle. However, the user can start the race in any gear he wishes and as long as the gear pushbutton switch GR is depressed (like depressing a clutch pedal), the engine can be "revved" up with the gas pushbutton GA while the lamps 1Y-5Y are lit. The screech oscillator OSC3 simulates a tire squeal only when shifting into first and not when shifting into second, third or fourth.

As at any other time, if the maximum or red line RPM that corresponds to the skill or class that the player has selected via the switch SK is exceeded, the engine will "blow" and an exploding sound is produced via the speaker SP, this being caused by the generator NG which provides a pseudo white noise, as previously mentioned. Once again, it will be stated that the oscillator OSC1 produces a frequency-variable signal that is delivered to the microprocessor MPU and the microprocessor MPU reacts to this frequency signal, transmitting an enabling signal from its pin 23 to the amplifier OR so that the noise generator NG delivers a signal to the speaker SP via the transistor Q1, operational amplifiers OQ, OR and the audio amplifier AA. Whenever this occurs, the race cannot be continued and the player must wait for the game to reset itself.

During the run or race the player is constantly informed of the engine speed by the continued display of a digital value on the display unit DS1 which is in accordance with the speed of the engine. Before his maximum or red line RPM is reached, though, he must shift gears by letting up on the gas pushbutton switch GA and depressing the gear pushbutton switch GR. The microprocessor MPU is programmed so as to require a rapid shift into second gear from first gear in order to avoid blowing the engine. The run is continued by shifting to third and fourth gear, being careful not to exceed the maximum RPM for the particular class or skill that has been selected, for exceeding the maximum RPM will cause the engine to blow by reason of the noise generator NG being automatically connected to the speaker SP. However, by shifting as close to the maximum RPM as he can (without exceeding the maximum for the particular race class he has selected) he reduces the elapsed time for the race. It should be kept in mind that the moment at which the race is officially started and from which moment the elapsed time is computed begins when the green LED 1G is energized.

Whereas the yellow lights 1Y-5Y indicate the initial countdown time until the green LED 1G is energized to start the clock and the beginning of a race, there is a reverse sequence of these four lights as the run or race progresses. Each of the lights, when reversely sequenced, represents one-fifth of the quarter mile being run. When the run is actually over, then the red light 1R flashes and concurrently with this happening, since it is indicative of the vehicle having crossed the finish line, the pitch of the sound resembling the engine speed will slowly decrease or wind down by reason of a decreasing voltage being generated by the ramp generator RG.

Immediately after the simulated race is finished, the display unit DS1, which constitutes a tachometer readout, shows a first number representative of the elapsed time ET for the race, the digital value being in seconds to the nearest one-hundredth second. Thus, the display of the number 919 would signify 9 and 19/100 seconds. This number is soon changed to a second number which is the miles per hour or MPH achieved at the end of the race. If this figure should be 247, then this is the miles per hour or MPH. The game or simulator 30 will then be automatically reset and the same maximum RPM for the particular class that has been selected via the switch SK will again be displayed on the display unit DS1; however the switch SK can be rotated to a different position SK1, SK2, SK3 or SK4 if a different class of race is desired. The simulator 30 is at this time ready for another race.

One of the niceties of the invention resides in the fact that two simulators or games 30 can be used in competition with each other by hooking the two devices together by a special cord (neither the second simulator 30 nor the cord being shown). The jack JA permits the interconnection to be readily effected. After interconnecting two simulators 30, a race can be run in the same class, that is, with the selector switch SK for each unit 30 being identically positioned, or one player can have a handicap by selecting a different class or skill level via the selector switch SK associated with his device 30 which results in his green LED 1G being turned on sooner by reason of the reduced time between the prestage yellow LED 1Y and the energization of the yellow LED 2Y. The inverval between the LED's 2Y, 3Y, 4Y and 5Y coming on does not change, but the shortened period between the two lights 1Y and 2Y does with the consequence that LED 1G lights sooner and the handicapped player gets a head start. The microprocessor MPU for each simulator 30 will automatically equalize the Christmas tree or start indicators DS3 and the clocked time will be measured so that the winner will be appropriately determined. The winner's LED 1R flashes while the loser's LED 1R glows constantly. Thus, while considerable realism and intrigue is incorporated into the operation of just one simulator 30 when the single player is racing against only the clock, striving to complete the quarter mile course in the least possible amount of elapsed time ET, an added dimension of real drag racing competition is experienced when two games 30 are interconnected.

We claim:

1. An electronic vehicle race simulator comprising sound producing means, means providing a relatively low frequency signal, means responsive to said signal for causing said sound producing means to provide a sound resembling the sound of a vehicle engine at a given speed, display means responsive to said signal for providing a numerical reading representative of engine speed at any given moment, manually-actuatable means, means controlled by said manually-actuatable means for increasing the frequency of said signal in accordance with the length of time said manually-actuatable means is actuated to cause said sound producing means to provide a higher pitch sound resembling a higher engine speed and to cause said display means to simultaneously provide a higher numerical reading representative of the higher engine speed, means for selecting a predetermined value of said frequency, means for detecting when said predetermined frequency value has been exceeded, and means responsive to said detecting means for interrupting the production of sound from said sound producing means after said frequency has increased to said predetermined value.

2. The vehicle race simulator of claim 1 in which said sound producing means is caused to provide a noise resembling an engine explosion when said frequency reaches said predetermined value.

3. An electronic vehicle race simulator comprising a speaker, means for delivering to said speaker a variable frequency signal for causing said speaker to produce a sound resembling the engine speed of a vehicle, voltage controlled oscillator means including first and second oscillators for varying the frequency of said signal to increase the pitch of said sound to indicate a higher engine speed, means for displaying numerical data representative of engine speed at any given moment, said display means being controlled by said variable frequency signal and said display means causing a higher number to be displayed in accordance with said higher engine speed by means of said display means being controlled by said variable frequency signal, means for delivering a noise producing signal to said speaker, means for selecting a predetermined frequency value for said first oscillator, and means controlled by said first oscillator for gating said noise producing signal to said speaker when the frequency of said first oscillator has increased to said predetermined value.

4. The vehicle race simulator of claim 3 including means for appreciably amplifying said noise producing signal when the frequency of said variable frequency signal has reached signal predetermined value, said noise producing signal causing said speaker to provide a sound resembling an engine explosion.

5. An electronic vehicle race simulator comprising a casing, means in said casing for producing a variable signal, means responsive to said signal for producing a sound resembling the engine speed of a vehicle, digital display means, means responsive to said signal for producing a digital reading on said display means representative of said engine speed, a gas pushbutton switch mounted on said casing, means controlled by the manual depressing and closing of said gas pushbutton switch for modifying said variable signal to increase the pitch of said sound to cause said sound to resemble a higher engine speed and to increase the digital reading on said display means, said signal being a variable frequency signal and the release and opening of said pushbutton switch decreasing the frequency of said signal to cause said sound to resemble a lower engine speed and the digital reading on said display means to have a correspondingly lower value, means on said casing for manually selecting one of a plurality of predetermined maximum engine speeds, means for causing said display means to initially provide a numerical reading indicative of the particular predetermined maximum engine speed that has been selected, and means responsive to the frequency of said signal for producing a sound resembling an engine explosion when the frequency corresponding to the particular predetermined maximum engine speed that has been selected is exceeded.

6. The vehicle race simulator of claim 5 including a gear pushbutton switch mounted on said casing, and means controlled by said gear pushbutton switch for reducing the frequency of said signal and thereby providing a sound resembling a lower engine speed than immediately preceding the depressing of said gear pushbutton switch.

7. An electronic drag race simulator comprising a casing having a panel, a group of lamps including first, second, third, fourth and fifth yellow lamps, a green lamp, said lamps being arranged in a generally straight line relation, means for energizing said lamps in sequence starting with said first yellow lamp and ending with said green lamp, means in said casing for producing a sound representative of the speed of a vehicle engine, a gear pushbutton switch, means associated with said gear pushbutton switch for disabling said sound producing means if said gear pushbutton switch is depressed and released before said green lamp has been energized, a gas pushbutton switch for causing, when actuated, said sound producing means to increase the pitch of said sound to represent a higher engine speed, means for selecting one of a plurality of predetermined pitches representative of engine speeds not to be exceeded, means for detecting when the selected predetermined pitch has been exceeded, and means for disabling said sound producing means at any time said gas pushbutton switch causes said sound to exceed a predetermined pitch.

8. The drag race simulator of claim 7 including means responsive to the frequency of said sound producing means for displaying a numerical value representative of engine speed.

9. The drag race simulator of claim 8 including display means on said casing, and means for initially causing said display means to display a numerical value indicative of the predetermined engine speed that has been selected.

10. The drag race simulator of claim 9 including means for later causing said display means to display a numerical value indicative of the elapsed time corresponding to a simulated distance.

11. The drag race simulator of claim 7 including a red lamp, and means for energizing said red lamp when said sound producing means is disabled.

12. An electronic drag race simulator comprising display means, manually-actuatable means, means for producing a relatively low frequency signal, means responsive to said relatively low frequency signal for providing a digital value on said display means corresponding to a relatively low speed of an engine, means controlled by said manually-actuatable means for increasing the frequency of said signal to a higher value so that said display means shows a digital value corresponding to a higher engine speed, said manually-actuatable means including a pushbutton switch, depressing said pushbutton switch causing said frequency to increase to cause said display means to show said digital value corresponding to said higher engine speed, and means for initially causing said display means to show a digital value that cannot be exeeded when depressing said pushbutton switch.

13. The drag race simulator of claim 12 including means for selecting one of several predetermined engine speeds to be displayed on said display means.

14. The drag race simulator of claim 12 in which said frequency increasing means includes a ramp generator for providing a voltage which increases in accordance with the length of time said pushbutton switch is manually depressed, oscillator means controlled by said voltage, said oscillator means providing said signal and the frequency of said signal increasing in accordance with said voltage.

15. The drag race simulator of claim 14 in which the frequency of said signal also decreases with a decrease in said voltage.

16. The drag race simulator of claim 15 in which said ramp generator includes resistor means and capacitor means, said pushbutton switch when depressed causing said capacitor means to progressively charge through said resistor means to increase said voltage and hence the frequency of said signal to produce a digital value corresponding to said higher engine speed.

17. The drag race simulator of claim 16 in which release of said pushbutton switch allows said switch to open to cause said capacitor means to discharge through said resistor means to decrease said voltage and the frequency of said signal to produce a digital value corresponding to a lower engine speed.

18. The drag race simulator of claim 14 including sound producing means to produce a sound resembling the sound of vehicle engine at said various speeds, and means controlled by said oscillator means for providing a second signal, the frequency of said second signal increasing in accordance with said voltage for causing said sound producing means to provide sounds having a pitch resembling the various engine speeds corresponding to the digital values shown on said display means.

19. An electronic drag race simulator comprising a casing having a panel, a group of lamps, means for energizing said lamps in sequence, display means, means for initially causing said display means to provide a numerical reading indicative of a particular predetermined maximum engine speed that has been selected, means providing a variable frequency signal which includes a frequency indicative of said predetermined maximum engine speed that has been selected, manually-actuatable means for initiating said sequential energization of said group of lamps, an additional lamp, and means responsive to said signal for energizing said additional lamp when said predetermined maximum speed has been exceeded.

20. The drag race simulator of claim 19 including means for selecting one of a plurality of predetermined speeds that should not be exceeded, said signal responsive means being responsive to the frequency indicative of the predetermined maximum engine speed that has been selected.

21. The drag race simulator of claim 20 including means responsive to said variable frequency signal for changing the digital value displayed on said display means.

22. The drag race simulator of claim 21 including means for later causing said display means to play a numerical value indicative of the elapsed time corresponding to a simulated distance.

23. The drag race simulator of claim 22 in which said additional lamp is energized when said race is over.

24. The drag race simulator of claim 23 including means for reversing the sequence for energizing said lamps prior to said additional lamp being energized to show the progress of said race.

25. An electronic drag race simulator comprising a casing, a gear switch for changing the gear position displayed on said gear position display means, RPM display means, a gas switch for changing the value of RPM displayed on said RPM display means, sound producing means for providing a sound resembling the speed of an engine, means controlled by said gas switch for changing the pitch of the sound from said sound producing means so as to resemble an increased engine speed, battery means for supplying power to said gear and gas switches, said gear and RPM display means, said sound producing means, and said means controlled by said gas switch, a series of lamps and a lamp for indicating the start of a race, said battery means also supplying power to said lamps, means for automatically energizing said start lamp after said series of lamps have been sequentially energized, a lamp for indicating the end of a race, means for causing said end of the race lamp to light when said gear switch is closed after said start switch has been closed and opened before said start light has been energized, means providing a signal representative of RPM, means for selecting a predetermined value of said signal that is indicative of an RPM value not to be exceeded, and means responsive to the predetermined value of said signal for causing said end of the race lamp to light when said RPM value exceeds said predetermined maximum.

26. The drag race simulator of claim 25 including a start switch and means responsive to the closure of said gear and start switches for initiating a sequential energization of said series of lamps.

27. The drag race simulator of claim 25 including means for causing said sound producing means to provide a noise resembling an engine explosion when said RPM value exceeds said predetermined maximum.

28. The drag race simulator of claim 27 including a selector switch for changing said predetermined maximum value.

29. An electronic drag race simulator comprising a casing, gear position display means, engine RPM display means, light means for indicating the start of a race, sound producing means for providing sounds resembling various engine speeds, means for showing on said RPM display means a digital value corresponding to the engine speed at any given time, a gear pushbutton switch for controlling said gear position display means, a gas pushbutton switch for controlling said sound producing means and said RPM display means, a start pushbutton switch for initiating the energization of said light means, and means requiring both said gear pushbutton switch and said start pushbutton switch to be closed in order to initiate energization of said light means.

30. An electronic drag race simulator comprising a casing, gear position display means, engine RPM display means, light means for indicating the start of a race, sound producing means for providing sounds resembling various engine speeds, means for showing on said RPM display means a digital value corresponding to the engine speed at any given time, a gear pushbutton switch for controlling said gear position display means, a gas pushbutton switch for controlling said sound producing means and said RPM display means, a start pushbutton switch for initiating the energization of said light means, a start pushbutton switch, said light means including a plurality of yellow lights and a green light, and means initiated by the closing of said gear pushbutton switch and said start pushbutton switch for causing sequential energization of said yellow lights followed by the energization of said green light.

31. The drag race simulator of claim 30 in which said light means includes a red light, and means for energizing said red light at the end of a race.

32. The drag race simulator of claim 31 including means for energizing said red light if a maximum RPM digital value is exceeded.

33. The drag race simulator of claim 32 including means for causing said sound producing means to provide a noise resembling an engine explosion when said maximum RPM value is exceeded.

34. The drag race simulator of claim 33 including a hand grip at each side of said casing so that the simulator can be held in one's hands, said gear pushbutton switch being adjacent one of said grips and said gas pushbutton switch being adjacent the other of said hand grips.

35. The drag race simulator of claim 34 in which said start switch is also adjacent said other hand grip.

* * * * *